US009581409B2

(12) United States Patent
Post

(10) Patent No.: US 9,581,409 B2
(45) Date of Patent: Feb. 28, 2017

(54) ACCELERATION OF OBJECTS TO HIGH VELOCITY BY ELECTROMAGNETIC FORCES

(71) Applicant: Lawrence Livermore National Security, LLC, Livermore, CA (US)

(72) Inventor: Richard F Post, Walnut Creek, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 605 days.

(21) Appl. No.: 14/099,933

(22) Filed: Dec. 7, 2013

(65) Prior Publication Data

US 2014/0116406 A1 May 1, 2014

Related U.S. Application Data

(63) Continuation of application No. 12/508,408, filed on Jul. 23, 2009, now abandoned.

(60) Provisional application No. 61/083,100, filed on Jul. 23, 2008.

(51) Int. Cl.
*F41B 6/00* (2006.01)

(52) U.S. Cl.
CPC ..... *F41B 6/003* (2013.01); *F41B 6/00* (2013.01)

(58) Field of Classification Search
CPC ..... F41B 6/00; F41B 6/003; F41B 6/006
USPC ..... 124/3; 310/12.07
See application file for complete search history.

(56) References Cited

U.S. PATENT DOCUMENTS

| | | | | |
|---|---|---|---|---|
| 1,384,769 | A | 7/1921 | MacCaren | |
| 1,985,254 | A | 12/1934 | Huse | |
| 4,432,333 | A | 2/1984 | Kurherr | |
| 4,870,888 | A | 10/1989 | Weldon et al. | |
| 4,926,741 | A * | 5/1990 | Zabar | F41B 6/00 124/3 |
| 4,966,884 | A | 10/1990 | Hilal | |
| 4,996,455 | A * | 2/1991 | Loffler | F41B 6/00 124/3 |
| 5,017,549 | A | 5/1991 | Robertson | |
| 5,024,137 | A | 6/1991 | Schroeder | |
| 5,125,321 | A * | 6/1992 | Cowan, Jr. | F41B 6/00 124/3 |
| 5,483,111 | A | 1/1996 | Kuznetsov | |
| 5,631,618 | A | 5/1997 | Trumper et al. | |
| 5,722,326 | A | 3/1998 | Post | |
| 6,393,993 | B1 | 5/2002 | Reese | |
| 6,629,503 | B2 | 10/2003 | Post | |

(Continued)

OTHER PUBLICATIONS

S. Barmada; A. Musolino; M. Raugi; R. Rizzo "Analysis of the performance of a multi-stage pulsed linear induction launcher" IEEE Transactions on Magnetics Year: 2001, vol. 37, Issue: 1 pp. 111-115, DOI: 10.1109/20.911802.*

(Continued)

*Primary Examiner* — Burton Mullins
(74) *Attorney, Agent, or Firm* — John P. Wooldridge

(57) ABSTRACT

Two exemplary approaches to the acceleration of projectiles are provided. Both approaches can utilize concepts associated with the Inductrack maglev system. Either of them provides an effective means of accelerating multi-kilogram projectiles to velocities of several kilometers per second, using launchers of order 10 meters in length, thus enabling the acceleration of projectiles to high velocities by electromagnetic forces.

22 Claims, 15 Drawing Sheets

(56) References Cited

U.S. PATENT DOCUMENTS

| | | | |
|---|---|---|---|
| 6,633,217 | B2 | 10/2003 | Post |
| 6,664,880 | B2 | 12/2003 | Post |
| 6,758,146 | B2 | 7/2004 | Post |
| 7,077,046 | B2 | 7/2006 | Nelyubin |
| 7,096,794 | B2 | 8/2006 | Post |
| 7,549,365 | B2 | 6/2009 | Root, Jr. |
| 7,598,646 | B2 | 10/2009 | Cleveland |

OTHER PUBLICATIONS

Z. Zabar; X. N. Lu; E. Levi; L. Birenbaum; J. Creedon "Experimental results and performance analysis of a 500 m/sec linear induction launcher (LIL)" IEEE Transactions on Magnetics Year: 1995, vol. 31, Issue: 1 pp. 522-527, DOI: 10.1109/20.364681.*

C. R. Hummer; P. R. Berning; C. E. Hollandsworth "Inductance calculation of a coil gun that launches a thin plate edge-on" Pulsed Power Conference, 1997. Digest of Technical Papers. 1997 11th IEEE International Year: 1997, vol. 2 pp. 1156-1161 vol. 2, DOI: 10.1109/PPC.1997.674555.*

I. R. Shokair; M. Cowan; R. J. Kaye; B. M. Marder "Performance of an induction coil launcher" IEEE Transactions on Magnetics Year: 1995, vol. 31, Issue: 1 pp. 510-515, DOI: 10.1109/20.364640.*

T. Burgess; E. Cnare; W. Oberkampf; S. Beard; M. Cowan "The electromagnetic θ gun and tubular projectiles" IEEE Transactions on Magnetics Year: 1982, vol. 18, Issue: 1 pp. 46-59, DOI: 10.1109/TMAG.1982.1061811.*

R. Haghmaram; A. Shoulaie "Literature review of theory and technology of air-core tubular linear induction motors [electromagnetic launcher applications]" Universities Power Engineering Conference, 2004. UPEC 2004. 39th International Year: 2004, vol. 2 pp. 517-522 vol. 1.*

M. Cowan; M. M. Widner; E. C. Cnare; B. W. Duggin; R. J. Kaye; J. R. Freeman "Exploratory development of the reconnection launcher 1986-90" IEEE Transactions on Magnetics Year: 1991, vol. 27, Issue: 1 pp. 563-567, DOI: 10.1109/20.101095.*

Z. Zabar; Y. Naot; L. Birenbaum; E. Levi; P. N. Joshi "Design and power conditioning for the coil-gun" IEEE Transactions on Magnetics Year: 1989, vol. 25, Issue: 1 pp. 627-631, DOI: 10.1109/20.22613.*

Peter P Mongeau "Inductively Commutated Coilguns" IEEE Transactions on Magnetics, vol. 27, No. 1, Jan. 1991.*

M. W. Ingram; J. A. Andrews; D. A. Bresie "An actively switched pulsed induction accelerator" IEEE Transactions on Magnetics Year: 1991, vol. 27, Issue: 1 pp. 591-595, DOI: 10.1109/20.101100 Referenced in: Cited by: Papers (10).*

D. A. Bresie; J. A. Andrews "Design of a reluctance accelerator" IEEE Transactions on Magnetics Year: 1991, vol. 27, Issue: 1 pp. 623-627, DOI: 10.1109/20.101106.*

C. R. Hummer; P. R. Berning; C. E. Hollandsworth "Inductance calculation of a coil gun that launches a thin plate edge-on" Pulsed Power Conference, 1997. Digest of Technical Papers. 1997 11th IEEE International Year: 1997, vol. 2 pp. 1156-1161 vol. 2, DOI:10.1109 PPC.1997.674555.*

Driga et al., "Advanced Concepts for Electromagnetic Launcher Power Supplies Incorporating Magnetic Flux Compression," IEEE Transactions on Magnetics, vol. 27, No. 1, pp. 350-355, (1991).

Haghmaram et al., "Literature Review of Theory and Technology of Air-Core Tubular Linear Induction Motors," 39th International Universities Power Engineering Conference, vol. 1, pp. 517-522, (2004).

Haghmaram et al., Study of Traveling Wave Tubular Linear Induction Motors, 2004 International Conference on Power System Technology, PowerCon, pp. 288-293, (2004).

* cited by examiner

| Cell No. | Cell length (m) | Phase velocity factor |
|---|---|---|
| 1 | 0.126 | 1.5 |
| 2 | 0.284 | 1.5 |
| 3 | 0.639 | 1.5 |
| 4 | 1.428 | 1.5 |
| 5 | 3.236 | 1.5 |
| 6 | 4.276 | 1.32 |

ACCELERATION OF OBJECTS TO HIGH VELOCITY BY ELECTROMAGNETIC FORCES

This is a continuation of U.S. application Ser. No. 12/508,408 titled "Acceleration of Objects to High Velocity by Electromagnetic Forces" filed Jul. 23, 2009, incorporated herein by reference, which claims priority to U.S. Provisional Patent Application Ser. No. 61/083,100, titled: "New Methods of Acceleration of Objects to High Velocity by Electromagnetic Forces," filed Jul. 23, 2008, incorporated herein by reference.

The United States Government has rights in this invention pursuant to Contract No. DE-AC52-07NA27344 between the United States Department of Energy and Lawrence Livermore National Security, LLC, for the operation of Lawrence Livermore National Laboratory.

BACKGROUND OF THE INVENTION

Field of the Invention

The present invention relates to Inductrack technology, and more specifically, it relates to the use of such technology for the acceleration of objects.

Description of Related Art

Prior work in acceleration of objects to high speeds by electromagnetic forces has been concentrated on the study of two approaches: (1) the Rail Gun, and (2) the Coil Gun. It is desirable to achieve higher launch velocities, without the contact-related and launcher wear problems of the prior art, as well as having higher efficiency in terms of the fraction of the it put electrical energy transferred to the projectile.

SUMMARY OF THE INVENTION

It is an object of the present invention to provide techniques for the acceleration of projectiles to high velocities by electromagnetic forces.

Another object is to provide effective means for accelerating multi-kilogram projectiles to velocities of several kilometers per second, using launchers of order 10 meters in length.

These and other objects will be apparent based on the disclosure herein.

The motivation for the present invention was the perception that the concepts and electrodynamic interactions involved in the Inductrack maglev concept developed at LLNL might be employed in devising new means for the acceleration of projectiles to high velocities. In particular, the Inductrack involves the contact-less acceleration and guidance of vehicles by techniques that it was felt could be adapted to this new use. Two such neo adaptations have been described, dubbed the INTOR and FLUXOR approaches. Computer codes, based on theory, were written and used to analyze these two concepts. These codes predict that both approaches enable achieving projectile velocities that are substantially above those of the present-day approaches, with the added advantage of avoiding the contact and wear problems of these approaches.

The invention provides methods for accelerating objects to high velocities by electromagnetic forces based in part on principles employed in the Inductrack approach to magnetic levitation. One embodiment employs a traveling wave of magnetic field to induce currents in Inductrack-track-like conducting surfaces on the object to be accelerated. The traveling wave of magnetic field is produced by Halbach-array-like fields produced by a special array of circuit wires.

This traveling wave then entrains and accelerates the object, while at the same time it provides contact-less guidance while the object is in the launcher. Another approach employs what could be called "conductivity-trapped magnetic flux" in accelerating an object down a launcher. That is, conducting surfaces on the object are initially immersed in a strong transverse magnetic field for a "skin-depth time," i.e., long enough for the field to "soak" into the conductors (typically of order 100 milliseconds in good conductors that are a centimeter or so in thickness. The applied field is then rapidly pulsed down, or separated from the object, in a time much shorter than a skin-depth time. The object is then subjected to strong currents that are directed around the object, i.e., at 90 degrees to the emerging field lines from the conductivity-trapped flux. These strong currents then both accelerate and guide the object in a contact-less manner.

The invention can be used by naval or ground-based artillery. It can be used by the U.S. Forest Service to propel large bio-degradable canisters of water into a forest fire, from distances of several miles, as a replacement for helicopter based means of fighting forest fires. It can be used for fire-fighting in city environments. It can be used by NASA for rocket launching as well as in civilian space applications.

U.S. Provisional Patent Application Ser. No. 61/083,100, titled: "New Methods of Acceleration of Objects to High Velocity by Electromagnetic Forces," filed Jul. 23, 2008, is incorporated herein by reference.

BRIEF DESCRIPTION OF THE DRAWINGS

The accompanying drawings, which are incorporated into and form a part of the disclosure, illustrate embodiments of the invention and, together with the description, serve to explain the principles of the invention.

DETAILED DESCRIPTION OF THE INVENTION

Figure 1A:
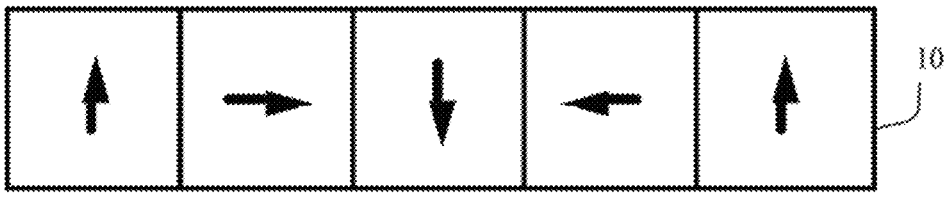
FIG. 1A is a schematic drawing of one wavelength of an M=4 Halbach array (configured to concentrate the magnetic field below the array).

For more than a decade studies have been underway at Lawrence Livermore National Laboratory of a magnetic levitation concept referred to as the Inductrack. These studies have culminated in the development at a full-scale test track at General Atomics in San Diego, Calif., en route to a commercially operating maglev transportation system. Because the Inductrack involves some novel applications of electromagnetic principles, it was thought that some aspects of the concept might be applicable to the problem of accelerating objects to high velocities by the use of electromagnetic forces.

Prior work in acceleration of objects to high speeds by electromagnetic forces has been concentrated on the study of two approaches: (1) The Rail Gun, and (2) The Coil Gun. The electromagnetic principles involved in the Inductrack differ greatly from those employed in either the Rail Gun or the Coil Gun, and thus offer new opportunities. The two general areas where Inductrack principles might be employed to achieve supersonic velocities are: (1) contact-less guidance of the accelerated object while in the launcher, and (2) contact-less electromagnetic propulsion. Both of these aspects of the problem are discussed here. The "contact-less" nature of both guidance and acceleration eliminates the problem of sliding electrical contacts and mechanical wear associated with the rail gun and guidance and wear problems associated with the coil gun.

Two distinct approaches, here dubbed the "INTOR" (a contraction of "Induction Accelerator"), and the "FLUXOR" (a contraction of "Flux-Trapping Accelerator") launchers, are described and analyzed. Both approaches employ advanced puked-power and magnetic field technology of the types developed in other fields, such as fusion research. Both approaches were shown to be capable of achieving projectile velocities in excess of 5 kilometers per second, using launchers of order 10 meters in length.

One of the basic principles involved in the Inductrack maglev system is the use of a special array of magnets, the Halbach Array. The virtue of the Halbach array is that it produces a concentrated spatially periodic (sinusoidally varying) magnetic field near the front face of the array, while canceling the field on the back face of the array, thus making optimally efficient use Of the magnetic field energy. In the INTOR launcher, high-field Halbach arrays formed by pulsing special conductor arrays are employed, both for accelerating the projectiles, and for contact-less guidance.

In this approach a traveling wave of magnetic field with a spatially increasing velocity is generated. This traveling magnetic wave induces currents in fin-like conducting surfaces on the projectile. These currents interact back on the inducing field to produce both strong accelerating forces and a high-stiffness centering action which guides the projectile within the launcher. In a certain sense, the projectile "rides" the traveling wave in the same way that a surfboard "rides" on the front of an incoming wave. And, as with the surfer, the acceleration is "self-synchronizing." That is, once the projectile enters the accelerating section of the launcher and is entrained, its forward motion is automatically synchronized with that of the wave. Except for the use of pulsed Halbach arrays both to accelerate and to guide the projectile in a contact-less manner, this approach resembles a linear induction motor drive system. That is, the propulsion force is derived from the "slip" velocity between a traveling magnetic wave and a conducting surface. Examples are given below of projectiles of various masses being accelerated up to velocities in excess of 5 kilometers per second.

The second approach studied, the FLUXOR launcher, involves a phenomenon that ought be dubbed "conductivity trapping of magnetic flux." It depends on the fact that if a metallic conductor is immersed in a magnetic flux for a period of time in excess of its characteristic "skin effect" time, and if the externally generated magnetic flux is rapidly removed, the flux threading the conductor will be "trapped" within it. This trapped flux (and the external field associated with it) will remain, again, for a skin-effect time. In good conductors (such as aluminum or copper) with thicknesses of order a centimeter or so, the skin-effect times can be many milliseconds.

Based on the above flux-trapping effect, this new acceleration mechanism operates as follows: The projectile, an elongated conductor in the form of either a cylinder or a multi-finned object, would be immersed for a fraction of a second in a pulsed magnetic field. The field coils producing this pulsed field are configured so as to produce a strong radial field (in the case of a cylinder) or transverse field (in the case of a firmed structure) that becomes embedded in the conductor walls. The pulsed field is then rapidly removed, either by pulsing down the field coils or by separation of the conductor and the field coils. Following this operation the conductor is exposed to the magnetic field produced by an array of other conductors carrying strong currents in a direction perpendicular to the direction of the trapped-flux field lines emerging from the conductors. The Lorentz force produced by these currents then accelerates the projectile along the launcher, with no requirement for wave-synchronization of the fields. Since pulsed fields of the order of 10 Tesla are not difficult to achieve, nor are currents of order $10^5$ amperes in the accelerator conductors, forces on the projectile conductor of order $10^6$ Newtons per meter an be achieved. Using multi-turn accelerator conductor coils accelerating forces of order $10^7$ Newtons are achievable. Such a force maintained over a distance of 10 meters will accelerate an object with a mass of 10 kilograms to a velocity in excess of 4 kilometers per second. Examples are given where even higher velocities are predicted. Furthermore, in all of the examples given, the acceleration times are a few milliseconds, i.e., they are substantially shorter than the predicted skin-effect decay times in the conductor.

A third approach was considered and rejected. This approach would have involved the acceleration of a structure containing Halbach arrays that utilize high-field permanent magnets (Neodymium-Iron-Boron) to create field. This field would then be acted on by the windings of what is called a LSM (Linear Synchronous Motor). Not only was it found that the accelerating forces were marginal, even for very high pulsed currents in the LSM windings, but also that the degree of time-synchronization required between the position of the projectile and the currents in the LSM fields was prohibitively precise. Thus, although the synchronization requirements are not difficult to satisfy for LSMs used in a maglev train environment, they appear to be virtually impossible to achieve in the present application.

Development of embodiments of the present invention was aided from theoretical analyses and/or from specialized computer programs that were written, employing the Mathematica® platform. Descriptions of these computer programs are included infra.

The Inductrack maglev concept is based on the use of a special array of permanent magnets. This type of array is known as the Halbach array. A common form of this array, called an M=4 array, is shown schematically in FIG. 1. This particular array is one that is configured to concentrate the magnetic field below the array).

Figure 1B:
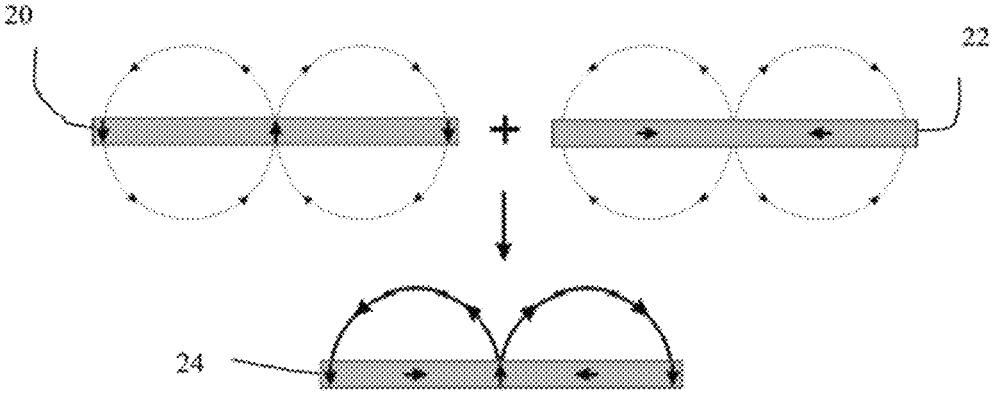
FIG. 1B graphically explains how the combined fields from a magnetic pieces 20 and 22 cancel on the bottom and add on the top of piece 24.
Figure 2:
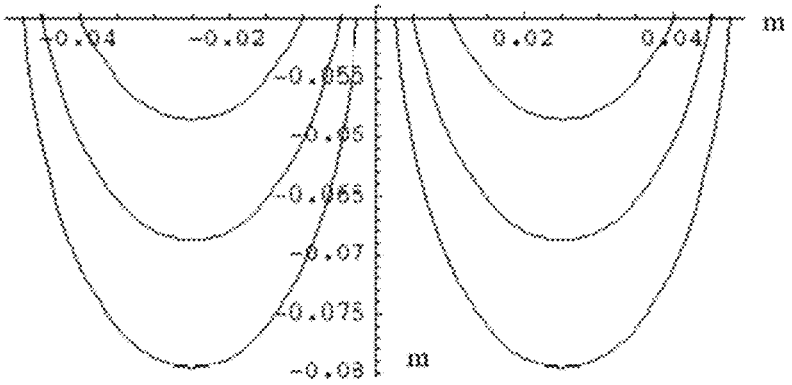
FIG. 2 is a calculated field line configuration below an M=4 Halbach array with a wavelength of 0.1 meter

As can be seen from FIG. 1A, the direction of polarization of the permanent-magnet bars that make up an M=4 Halbach array rotates by 90° between each magnet. Thus the direction of polarization rotates by 360° every four magnets, corresponding to one "wavelength" of the Halbach array, and explaining the origin of the "M=4" (four magnet bars per wavelength) designation for this, the simplest form of Halbach array. A higher-order array, for example an M=8 array, would have polarizations that rotate by 45° between magnets. Depending on the direction of rotation of the polarization from magnet to magnet of a Halbach array, the magnetic field components are additive outside one face of the array, while they cancel outside the opposite face. In FIG. 1A, the direction of rotation of the polarization in moving from left to right is clockwise, which results in the magnetic field outside the array being concentrated below the array, while being canceled above the array. FIG. 1B graphically explains how the combined fields from a magnetic pieces 20 and 22 cancel on the bottom and add on the top of piece 24. FIG. 2 shows the shape of the field Lines below an M=4 array such as shown in FIG. 1A, as calculated from the field equations that are discussed infra. This figure shows the field line configuration below an M=4 Halbach array with a wavelength of 0.1 meter.

The property of the Halbach array that results in concentrating the field on the front face of the array, while canceling it on the back face assures the most efficient use of the magnetic field generated by the array. Furthermore, the periodic magnetic field produced by the array varies sinusoidally with distance along the array, while decreasing exponentially with perpendicular distance from the array. Although Halbach invented his array for the purpose of focusing particle beams, its characteristics make it ideally suited to provide the levitating magnetic fields of the Inductrack. In preparation for the discussions to follow, a brief summary of the theory of the Halbach array and its use in the Inductrack maglev system will be given.

The starting point of the theoretical analysis of the Inductrack is the definition of the periodic magnetic fields produced by a single planar Halbach array. Except for end effects (which in typical cases, introduce only small corrections to the results) these fields are defined by the equations given below:

$$B_x = B_0 \sin(kx)\exp[-k(y_1 - y)] \text{ Tesla} \tag{1}$$

$$B_y = B_0 \cos(kx)\exp[-k(y_1 - y)] \text{ Tesla} \tag{2}$$

Here $y_1$ (m.) is the vertical distance between the lower surface of the Halbach array and the center line of the conductors of the track. $B_0$ (Tesla) is the peak strength of the magnetic field at the "active" surface of the array, given by the expression:

$$B_0 = B_r[1 - \exp(-kd)]\frac{\sin(\pi/M)}{\pi/M} \text{ Tesla} \tag{3}$$

In this expression $B_r$ (Tesla) is the remanent magnetic field of the permanent magnet material, $k=2\pi/\lambda$, where $\lambda$ (m.) is the wavelength of the Halbach array, d (m.) is the thickness of the Halbach array magnets, and M is the number of magnet bars per wavelength in the Halbach array. In the figure, $d=\lambda/4$ (i.e., square cross-section bars).

The track circuits can either be of the form of rectangular coils, close-packed together, or in the form of a planar ladder-like configuration, with transverse conductors shorted at the ends by longitudinal bus bars. The "track" is called a "laminated track," that is, it is created by slotting a laminate made up of rectangular sheets of a conductor (here aluminum). The slots do not extend to the edges of the sheets, the ends thus providing "shorting" of the array of strip conductors created by slotting the sheets. The slotting guarantees that the currents induced in the "track" by the moving Halbach array will flow in a transverse direction, this optimizing the levitation force.

Expressions for the lift and drag forces per unit of area of the Halbach array result from integrating the magnetic flux through these circuits and averaging over time. The ratio of these two forces then yields a simple expression for the Lift/Drag ratio, given by Equation 4:

$$\frac{\text{Lift}}{\text{Drag}} = kv\left[\frac{L}{R}\right] \tag{4}$$

Here L (henrys) and R (ohms) are the total inductance (self plus mutual) and resistance of a circuit in the track, respectively, and v (m./sec.) is the velocity of the moving Halbach array relative to the track. The "transition velocity," $v_t$ (m/sec.), is herein defined as that velocity where the lift force (which is zero at zero velocity) becomes equal to the drag force. For typical track designs, the transition velocity is very low, on the order of a few kilometers per hour. Its value is given by Equation 5:

$$v_t = \frac{\lambda}{2\pi}\left[\frac{R}{L}\right] \text{ meters/sec.} \tag{5}$$

Inserting this definition into Equation 4, the Lift/Drag ratio for Inductrack I takes the simple form given in Equation 6.

$$\frac{\text{Lift}}{\text{Drag}} = \frac{v}{v_t} \tag{6}$$

With these definitions, the levitation and drag forces (per unit area of Halbach array) are given by Equations 7 and 8 respectively. In the first approach of this report, the INTOR, the drag force is utilized to produce the accelerating force on the projectile.

$$\frac{F_y}{A} = \frac{B_0^2 w}{2kLd_c}\left[\frac{1}{1+(v_t/v)^2}\right]\exp(-2ky_1) \text{ Newtons/m}^2 \tag{7}$$

$$\frac{F_x}{A} = \frac{B_0^2 w}{2kLd_c}\left[\frac{\left(\frac{v_t}{v}\right)}{1+(v_t/v)^2}\right]\exp(-2ky_1) \text{ Newtons/m}^2 \tag{8}$$

Here w (m.) is the width of the Halbach array, and $d_c$ (m.) is the center-to-center longitudinal spacing of the track circuits. From the theory of the Inductrack, the value of the inductance, L (hy), of the track circuits can be defined in terms of their geometric parameters. This quantity is called the "distributed inductance," $L_d$, since it includes the wavelength-weighted effect of the adjacent circuits. This inductance is given by the expression in Equation 9.

$$L_d = \frac{\mu_0 P_c}{2kd_c} \text{ Henrys} \tag{9}$$

Here $\mu_0=4\pi\times10^{-7}$ (H/m) and $P_c$ (m.) is the perimeter of the circuit. When this definition is inserted into Equation (7), and in the limit of velocities that are high compared to the transition velocity, the levitation force per unit area is given by Equation (10):

$$\frac{F_y}{A} = \frac{B_0^2}{\mu_0}\left[\frac{w}{P_c}\right]\exp(-2ky_1) \text{ Newtons/m}^2 \tag{10}$$

Note that for the case of a laminated track (where $P_c$ is approximately equal to w), the levitation force approaches a limit that is four times higher than one would expect from a simple estimate of the strength of the magnetic field of the Halbach array as evaluated at the surface of the track. This factor-of-four increase comes from the fact that the currents induced in the track in this limit have the effect of canceling the magnetic field below the track and doubling it above the surface of the track. This large an effect would not occur if the circuits were not in a close-packed configuration, such as that produced by a laminated track.

In the INTOR system, the acceleration and contact-less guidance of the projectile is accomplished by employing a pulsed-conductor version of a dual Halbach array. When formed from bars of permanent magnet material, the dual Halbach array magnet configuration is shown schematically in FIG. 3. In the figure, the dual M=4 Halbach arrays 30 and 32 are phased with respect to each other so as to produce additive vertical field components in the region between them.

This magnet configuration produces a magnetic field between the arrays the vertical component of which is twice that produced by a single Halbach array, thus doubling the magnitude of the accelerating (drag) force produced by currents induced in a "track" located between the arrays when moving relative to the track. At the same time the horizontal field component of the field from this configuration of the dual Halbach array cancels at the midplane of the track, while increasing steeply with displacement of the track from its central position. This property of the field results in the creation of very strong contact-less centering forces on the track.

In the INTOR launcher approach to be discussed in this report, pulsed versions of the Halbach array are employed in order to create a traveling, accelerating, wave of magnetic field. In this approach, drag forces exerted on fin-shaped conductors by this traveling field accelerate the projectile.

To produce a pulsed version of the Halbach array, the permanent-magnet bars of the conventional Halbach array are replaced by conductors that carry pulsed currents. This replacement can be "exact" in the case where the conductors are sheet-like and are located so as to reproduce the Amperian current distribution on the surfaces of the permanent-magnet bars. In this case the magnetic fields produced outside the array would be essentially identical to those produced by permanent magnet bars, but with an intensity that is determined by the surface current density (amperes per meter) in the sheet conductors. The equivalent "remanent field" that results from a given surface current density, i (amperes/meter), in the sheet conductor is given by Equation 11 below.

$$B_r(\text{equiv.})=\mu_0 i \text{ (amperes/meter)} \tag{11}$$

Here $\mu_0=4\pi\times10^{-7}$ (henrys per meter). From this equation it can be seen that the Amperian currents associated with remanent fields of permanent magnet materials such as NdFeB, which are of order 1.4 T, correspond to surface current densities that are of order $10^6$ amperes meter.

Figure 4:
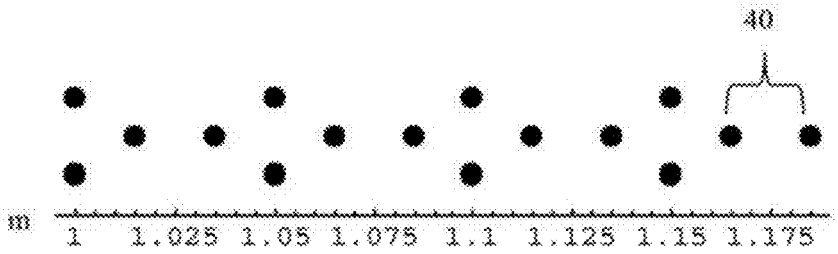
FIG. 4 is a plot of conductor locations for two-wavelength-long pulsed-dipole Halbach-array composed of four half-wavelength-long modules with the left edge of the array located at x=1.0 m. and its lower surface located at y1=0.01 m. from the plane of observation.

While strap-like conductors would be required to produce pulsed Halbach arrays the fields of which would accurately mimic those produced by permanent-magnet bars, nearly as good a result can be produced using discrete conductors, down to as few as 8 conductors per wavelength of the pulsed array. This somewhat counter-intuitive circumstance arises from considering the basic elements that make up a Halbach array. As an examination of FIG. 1 will show, the array is made up of a series of 2-D magnetic-dipole-like elements the orientation of which rotates from element to element. However a pair of conductors carrying currents in opposite directions, such as would result from exciting a long rectangular loop, will also create a 2-D dipole field. Thus eight such coils, located and oriented as shown end-on in FIG. 4, represent the most elementary form of a two-wavelength-long pulsed Halbach array. FIG. 4 is a plot of conductor locations for a two-wavelength-long pulsed-dipole Halbach-array composed of four half-wavelength-long modules with the left edge of the array located at x=1.0 m. and its lower surface located at y1=0.01 m. from the plane of observation.

Figure 5:
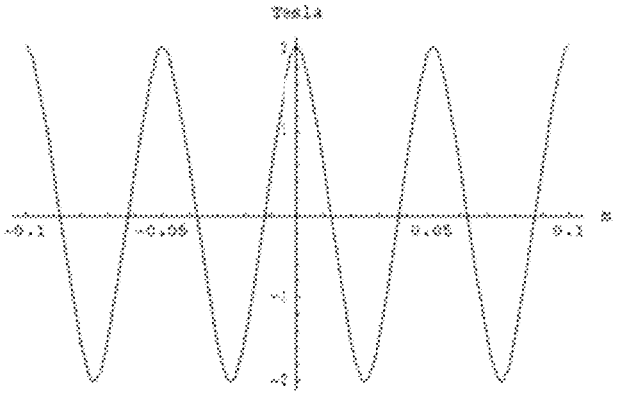
FIG. 5 is a plot of the calculated $B_x$ at a distance of 1.0 cm. from the face of a pulsed Halbach array with a configuration as shown in FIG. 4. The current in each conductor is $10^5$ amperes.

In order to calculate the magnetic fields produced by pulsed Halbach arrays of the type described, a computer code using the Mathematica® platform was written (a brief description of this code is given in Appendix C). FIG. 5 is a plot of the x (transverse) component of the magnetic field produced by a two-wavelength-long pulsed array with the conductor configuration shown in FIG. 4. The plot shows the calculated $B_x$ at a distance of 1.0 cm from the face of a pulsed Halbach array with a configuration as shown in FIG. 4. The current in each conductor is $10^5$ amperes.

When compared with the magnetic field generated by a conventional Halbach array using permanent-Magnet bars, the field shown in FIG. 5 was seen to be almost identical to the field that would be produced by such an array if it could be composed of permanent magnets with a remanent field of 12.6 Tesla (far higher than that attainable with present-day permanent-magnet materials).

In the INTOR approach, pulsed Halbach arrays of varying wavelength and frequency of excitation are used to create acceleration cells that generate a traveling wave of magnetic field the velocity of which increases with distance along the cell. This traveling wave then induces currents in fin-like conductors on the projectile. These currents then interact back on the wave to produce a forward-going force accelerating the projectile to supersonic velocities. As noted earlier, as long as the amplitude of the traveling wave exceeds a critical value the acceleration process is self-synchronizing, i.e., the projectile is entrained and then accelerated, stably by the drag force field exerted by the accelerating wave as its velocity increases in moving down the launcher.

Figure 3:
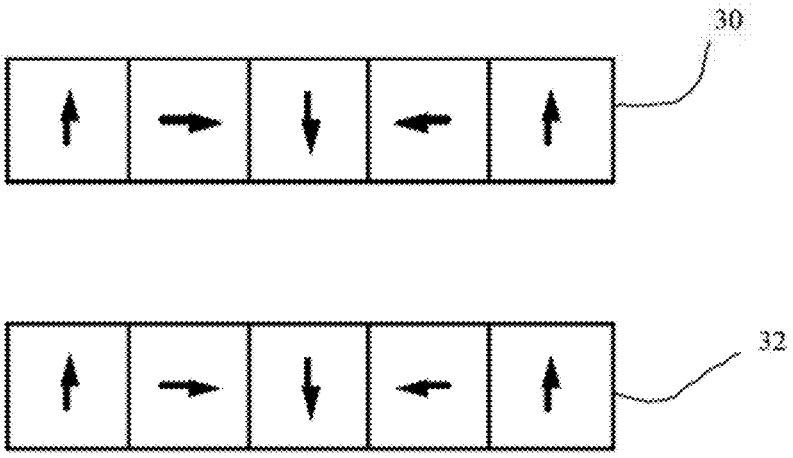
FIG. 3 is a schematic drawing of dual M=4 Halbach arrays phased with respect to each so as to produce additive vertical field components in the region between them.

In order to implement the acceleration mechanisms of the INTOR and FLUXOR approaches the geometry of the projectile must be compatible with these acceleration mechanisms. In the case of the INTOR, the geometry is that of a long cylindrical core to which are attached three or more fins consisting of bonded laminates of slotted sheet conductors (as noted, similar to the "laminated track" employed in the Inductrack maglev system). This finned projectile is accelerated and guided by dual Halbach arrays made up of two pulsed arrays of the type shown in FIG. 4 of the previous section, phased with respect to each other in the polarization orientations that are depicted in FIG. 3, i.e., so as to produce a strong transverse magnetic field between the arrays.

Figures 6A, 6B:
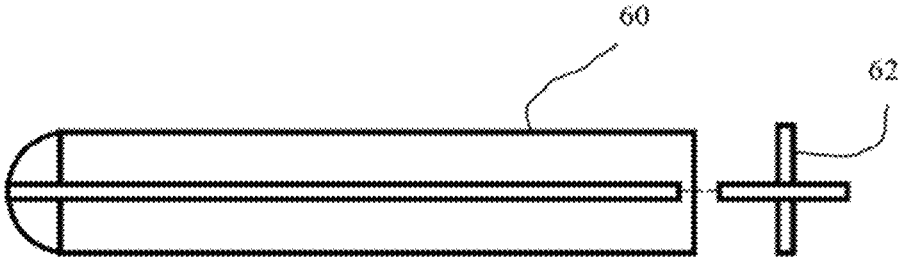
FIG. 6A is a schematic side drawing of a four-finned projectile for use with either the INTOR or the FLUXOR approach and FIG. 6B is an end on drawings of the projectile of FIG. 6A.

FIGS. 6A and 6B are schematic side 60 and end-on 62 drawings of a four-finned projectile that would be compatible with the accelerating mechanisms of both the INTOR and the FLUXOR approach. As noted previously, it can consist of a cylindrical central core to which are attached fin-like conductors (four in the example, although higher numbers of fins can be employed in order to increase the effective area of the conductors for a given projectile length).

For FLUXOR launchers, not only can the projectile configuration as shown in FIGS. 6A and 6B be used, but also a projectile in the form of a hollow thick-walled cylinder (with rounding of the front surface of the cylinder to reduce aerodynamic drag) could be employed. Based on these examples, other configurations of the launchers and projectiles for both the INTOR and the FLUXOR approaches will be apparent to those skilled in the art.

Note that in cases where it is desirable to impart a spinning motion to the projectile during the launching process, the fins of the projectile can be shaped so as to confirm to a long-pitch screw, matching the pitch of a similarly shaped array of pulsed dual Halbach array conductors.

In order to assess the effect of projectile configuration variations on the range of the accelerated projectiles, a computer program was written (briefly described in Appendix B) to provide a prediction of the maximum range and the impact kinetic energy of projectiles accelerated by either of the two approaches. Certain simplifying approximations were made in writing the program. One such approximation was to represent the aerodynamic drag by a constant drag coefficient, $c_d$, independent of velocity, so that aerodynamic drag is represented by Equation 12, as follows:

$$\text{Drag Force}=c_d A[\tfrac{1}{2}\rho(y)v^2]\ \text{Newtons} \tag{12}$$

Here A ($m^2$) is the frontal area of the projectile, ρ(y) is the density of the atmosphere ($kg/m^3$) as a function of altitude y (m), and v (m/sec) is the velocity of the projectile. For the quantity ρ(y) the "standard atmosphere" as listed in the handbooks was employed. Another approximation was to ignore the earth's curvature.

The TRAJ computer program was benchmarked against the range of existing or past naval artillery. Good agreement with these data was obtained using values of $c_d$ of about 0.3. The program was then used to obtain approximate predictions of the range and impact energy of projectiles accelerated by either the INTOR approach or the FLUXOR approach.

Figure 7:
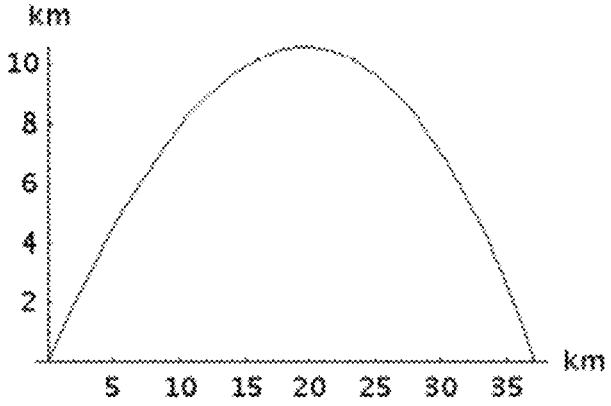
FIG. 7 is a TRAJ-predicted trajectory of AP-type projectile fired from a 16-inch gun at an elevation of 45°.

An example of a trajectory (plot of height vs horizontal distance) predicted by the code, for the case of an AP-type shell fired from a 16-inch gun is shown in FIG. 7. Specifically, FIG. 7 shows the TRAJ-predicted trajectory of an AP-type projectile fired from a 16-inch gun at an elevation of 45°.

The code-predicted maximum range is 37.1 kilometers (40,600 yards). Similar agreement was found in the case of a 5-inch gun, firing a 54 pound shell.

The projectile configurations and the trajectory code that was developed will be employed in the calculations of the predicted performance of the INTOR and the FLUXOR launchers, as described in infra.

As with any approach to the launching of a projectile using electromagnetic forces, the technology required is demanding, involving high current, high voltage, energy storage and switching systems and low-inductance transmission lines. Also, the electromagnetic forces on the launching system conductors can be large, as can the transient heating effects. Fortunately, many of these problems have already been faced and overcome in other technological developments, such as fusion research, research into high-power rf systems, and pulsed-power systems used in particle accelerators. It is important to discuss the salient features of the pulsed power technology that would be required and provide example approaches to the issues involved.

In considering the pulsed-power approaches needed to implement the INTOR approach, the dominant problem is that of creating a high current traveling wave of magnetic field the velocity of which increases along the length of the launcher. The methods of procedure of the INTOR require that the projectile enter the acceleration region with an initial velocity of at least some hundreds of meters per second. One way of approaching this problem is to use fast-acting valves to release high-pressure gas into the breech of the launcher, thus giving the projectile the needed initial velocity. Another technique is to use specially shaped pulsed coils to induce eddy currents in conductors at the rear of the projectile, giving it an initial impulse in the same way that the coil gun operates. Still a third method is to use a truncated version of the FLUXOR system to impart the initial velocity.

Once the projectile moves beyond the breech of the launcher with its initial velocity, it must be accelerated by the traveling magnetic waves in the launcher to speeds that are ten or more times faster than the speed at which it leaves the breech region. Two exemplary approaches to the creation of this traveling wave are provided. One approach uses a series of circuits containing charged condensers to produce pulse-current trains with a frequency that increases from one train to the next. These currents then excite pulsed Halbach arrays the characteristic wavelength of which increases with distance down the launcher. Another approach for creating a traveling wave uses high-power inverters the output frequency of which would increase with time so as to produce a corresponding increase in wave velocity produced by the pulsed Halbach arrays.

For both of these approaches the problem of generating the traveling magnetic wave is simplified substantially if sequential launcher circuits are employed. For example, if the launcher tube is 10 meters long it might contain, several cells, with each cell being fed by independent pulsed-power systems having characteristic wave frequencies and pulse-train lengths appropriate to matching the velocity and acceleration parameters of the projectile as it gathers speed in moving down the launcher. As the analysis given infra shows, the profile of the acceleration must take into account the limits imposed by the need to stably capture and accelerate the projectile throughout the length of the launcher. In the first approach described (condenser-discharge circuits), the effect of the finite length of the projectile as compared to that of the launcher tube is taken into account.

To illustrate the order of magnitude of the acceleration constants involved in either of the two pulsed-power techniques needed in the INTOR, consider the frequency and wavelength parameters that are appropriate to the projectile when it passes through six acceleration cells before reaching a final velocity of 5 kilometers/second. The lengths of the cells would vary with position along the launcher to take Into account the differing increments in phase velocity per unit length (typically highest at the front of the launcher. For this example, the acceleration force is constant within the launcher. (Optimized cases can employ non-uniform acceleration force vs distance profiles, with lower accelerations at the breech end, taking into account the finite length of the projectile.)

Figures 8, 9:
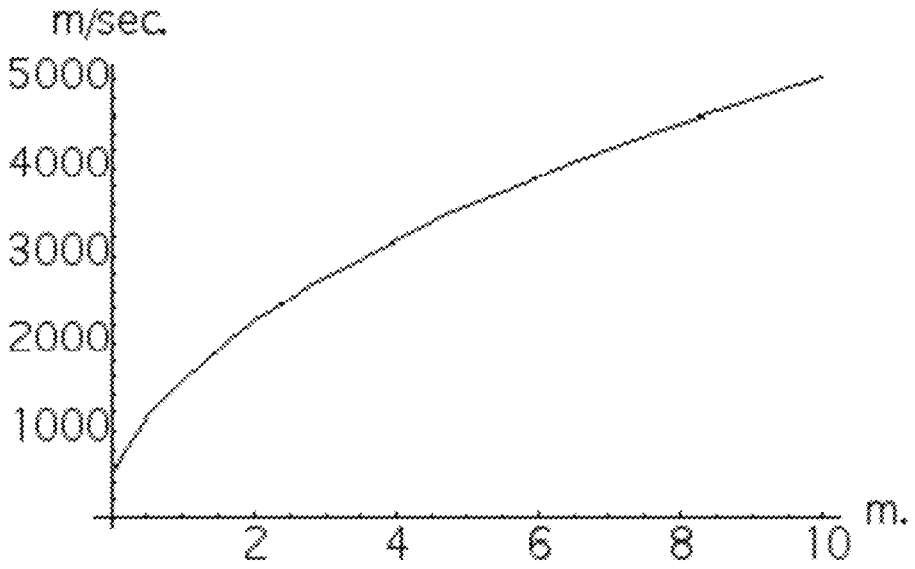
FIG. 8 is a plot of velocity vs distance down the launcher for the example case
FIG. 9 shows exemplary cell lengths and phase velocity factors.

If the projectile is launched at say, 0.5 km/second and is to be accelerated by an additional 4.5 km/sec so as to reach 5 km/sec in 10 meters, the velocity at any position, x, down the launcher is represented by Equation (13), shown plotted in FIG. 8.

$$v(x)=(a_0\cdot(x+x_0))^{1/2}\ \text{meters/sec} \tag{13}$$

FIG. 8A is a plot of velocity vs distance down the launcher for the example case The constant $x_0$ is given in terms of the initial velocity, v(x=0), and the acceleration constant, $a_0$, by Equation (14):

$$x_0=(1/a_0)[v(x=0)]^2\ \text{meters} \tag{14}$$

Differentiating Equation (13) with respect to x we find for the phase velocity increment per unit length the result:

$$\frac{dv}{dx}=(a_0/2)[a_0(x+x_0)]^{(-1/2)}\ \text{sec}^{-1} \tag{15}$$

For the example case, solving Equations (13) and (14) for the acceleration constant $a_a$, and the constant $x_0$, it is found that $a_a=2.475\times10^6$ (m/sec$^2$) and $x_0=0.101$ (m). Assuming that that the factor by which the phase velocity increases within each cell is a constant, equal to 1.5 (i.e., a 50 percent increase in phase velocity within each cell), it follows that the length of the cells will increase in moving from the breech to the end of the launcher. For this example, the cell lengths and phase velocity factor of increase are given in FIG. 9. Note that the last cell has a slightly lower phase velocity factor than the others.

Figure 10:
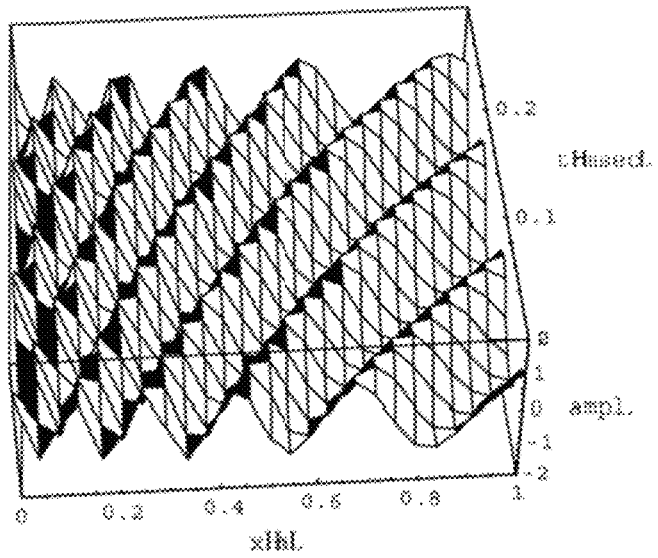
FIG. 10 is a 3-D Graphical representation of an accelerating traveling wave created by the superposition of two phase-shifted standing waves.

The first of the two means considered to accomplish the objective of increasing the phase velocity within a cell is to have the wavelength of the pulsed Halbach arrays increase along the arrays by a factor equal to the phase velocity factor, while the frequency of the pulse circuits that excite these arrays increases by the same factor from one cell to the next. Since the phase velocity of the wave is equal to the product of frequency and wavelength, the end effect would be to have the phase velocity of the wave smoothly increase from 500 m/sec to 5.0 km/sec in moving down the launcher. The job of the pulsed Halbach arrays would therefore be to produce a traveling wave the amplitude of which exceeds the critical amplitude for entraining and accelerating the projectile. An effective way to produce a traveling wave is to superpose the fields of two pulsed Halbach arrays that are interleaved with each other with their conductor arrays spatially displaced by one-quarter of a local wavelength and their exciting currents displaced in time phase by one-quarter period. That is, the superposition of two standing waves, phase-shifted by $\pi/2$ radians with respect to each other, forms a traveling wave field. A 3-D graphical representation of such a wave, with a phase velocity that increases from 1000 m/sec to 2000 m/sec over a distance of 1.0 meter is shown in FIG. 10. That is, FIG. 10 shows a 3-D graphical representation of an accelerating traveling wave created by the superposition, of two phase-shifted standing waves.

As noted above, the creation of the traveling waves required by the INTOR launcher can be accomplished either by the use of pulsed LC circuits to generate a multi-period sinusoidal wave train, with a provision for recharging the capacitors during the generation of the wave train or by the use of a series of high-power inverters, the output frequency of which increases as the projectile moves down the launcher. Examples of the acceleration parameters for both approaches will be given below.

In the Inductrack maglev system, Halbach arrays on the moving vehicle induce currents in a track that levitates the train. The resistive losses associated with these currents then results in a drag force exerted on the moving Halbach arrays. It follows that if one creates a set of moving, accelerating, dual Halbach arrays, using pulsed conductors in the manner described herein, one has in effect created a special type of linear induction motor. In operation, the magnetic fields from these arrays induce currents in a track-like conductor that will both accelerate it and keep it centered between the arrays. Using pulsed-power techniques, it is possible to create ver high transient magnetic fields between the arrays, leading to large accelerating and centering forces on the track. In particular, here the "track" is one of the fins of a projectile shapes as, e.g., shown in FIG. 6. The use of multiple fins, as shown in that figure, increases the fin area, thus increasing the accelerating force on the projectile, and also assures contact-less guidance of the projectile down the barrel of the launcher. Furthermore, as noted earlier, by imparting a helical pitch to the accelerating pulsed Halbach arrays, with a matching pitch in the fins, the projectile can be launched with an initial spin velocity, when this is desirable.

Using theoretical expressions derived in the analysis of the Inductrack a computer program, TRAV, was written (see Appendix D for a description of this program) that can be used to predict the accelerated motion of a finned projectile down the barrel of a launcher containing pulsed Halbach arrays of the type described herein. The code is capable of analyzing both of the pulsed-power techniques (i.e., condenser-discharge or high-power inverters) that have been described. Using attainable values for the parameters of the pulsed Halbach arrays, projectile velocities of order 5 km/sec or higher for both of these excitation means were predicted by TRAV. A description of the condenser-discharge mode of operation is provided below.

It should be noted that for the first excitation technique (condenser-discharge), the effects of the finite length of the projectile on its acceleration represent a major difficulty in achieving entrainment of the projectile by the traveling wave. Entrainment requires that the average accelerating force should increase with increasing slip velocity. Because of the gradient in wave velocity associated with an accelerating wave front, only a portion of the length of the projectile will be able to satisfy this requirement in terms of the relative velocity between the projectile and the local wave velocity of the accelerating fields. In the TRAV code the acceleration profile was tailored so as to ameliorate this entrainment problem. This type of profile would therefore be required of the pulsed Halbach arrays.

An example of the results of the TRAV code calculations is reproduced in the plots given below. These depict various aspects of the acceleration of a 5-finned projectile 0.75 meter in length, weighing 10 kilograms. Each fin is 80 mm wide and 20 mm in thickness. The total area of the fins on the projectile is 0.3 $m^2$, and the frontal area of the projectile is 0.004 $m^2$. (This example counts only the frontal area of the fins. Other needed structure can increase this frontal area.)

Figure 11:
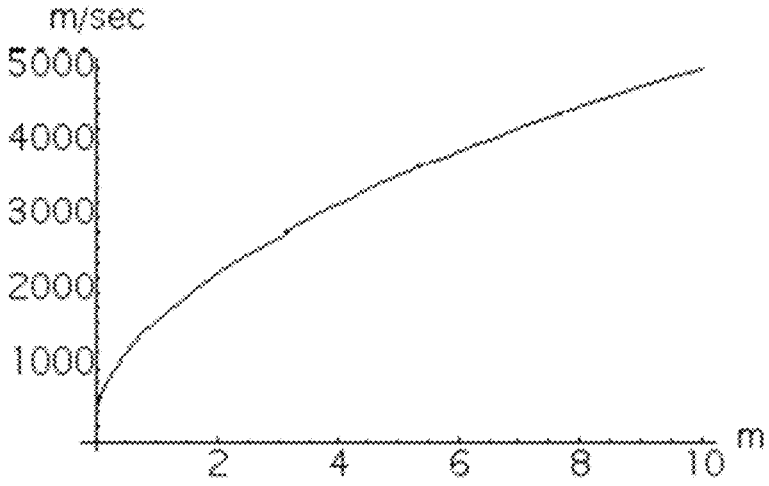
FIG. 11 is a plot of wave front velocity vs distance down the launcher

FIG. 11 is a plot of wave front velocity vs distance down the launcher. Starting at just over 500 m/sec, the wave front velocity increases to over 5000 m/sec by the end of the 10-meter-long launcher.

Figure 12:
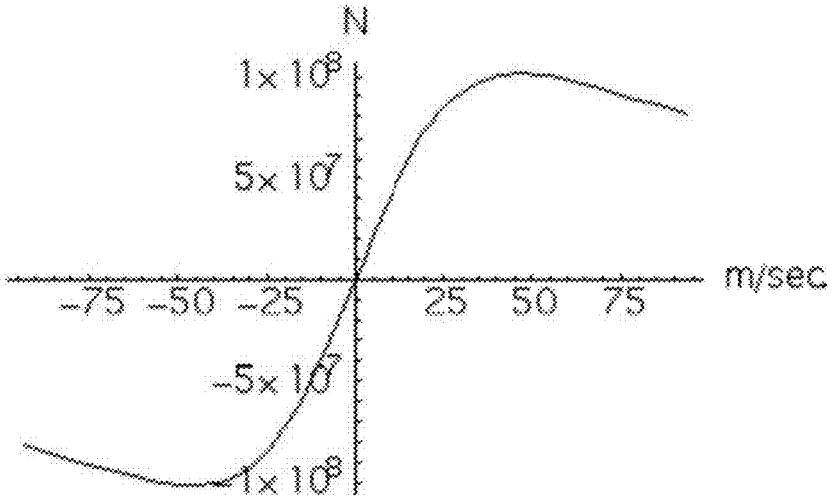
FIG. 12 is a plot of drag (accelerating) knee per square meter of fin area vs relative velocity at zero displacement (with respect to the midplane between the Halbach arrays).

For the example to be given, the "tracks" (that is the fins) of the projectile are made of a fiber-composite-reinforced laminate of sheets of aluminum alloy. Each sheet is slotted transversely with thin slots that terminate before the edges of the sheets, thus forming a pattern of shorted electrical circuits. The electrical properties of this type of "laminated track" configuration have been investigated in depth in connection with the studies, at LLNL, of the Inductrack maglev concept. For the example given here, the laminate was formed of 2 sheets of 1.0 mm-thick aluminum alloy, slotted to form a pattern of 2.5 mm-wide strips. The pulsed Halbach arrays operated at a level corresponding to an equivalent remanent magnetic field of 13.5 Tesla, corresponding to poked currents in the conductor arrays of approximately 200,000 amperes. With these parameters the calculated peak value of accelerating force was $1.01\times10^8$ Newtons/$m^2$. A plot of the accelerating force per square meter of fin vs the relative velocity between the wave and the projectile is shown in FIG. 12. That is, FIG. 12 is a plot of drag (accelerating) force per square meter of fin area vs relative velocity at zero displacement (with respect to the midplane between the Halbach arrays).

As shown by the plot of FIG. 12, the maximum accelerating force occurs at a relative velocity (between the projectile and the local value of the wave velocity) of about 45 m/second, beyond which the accelerating force decreases monotonically toward zero. Note that stable entrainment of the projectile by the moving wave requires that the local value of the relative velocity between the projectile and the accelerating wave should be less than the relative velocity of maximum accelerating force (here 45 m/second) for at least some reasonable fraction of the total length of the projectile. The code determines the limits imposed by this condition. When this condition is not sufficiently well satisfied the projectile will no longer be entrained by the wave and thus it will no longer be stably accelerated by the wave, its velocity falling far behind that of the wave.

Figure 13:
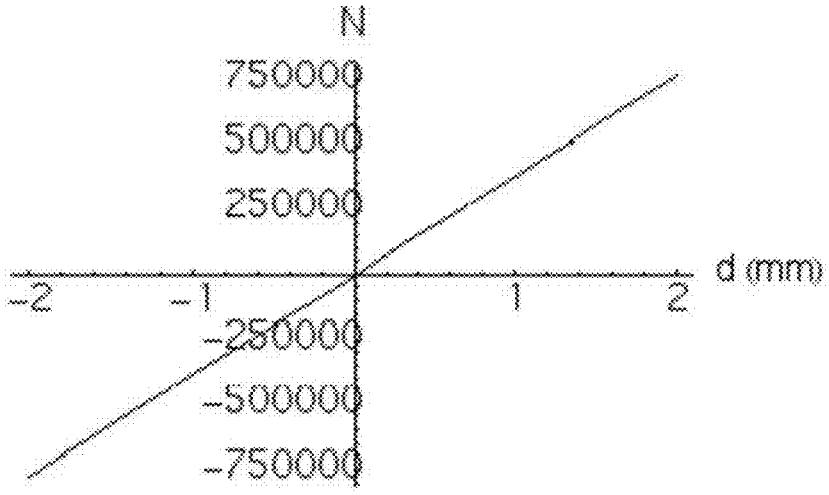
FIG. 13 is a plot of the calculated centering force exerted on each fin by the pulsed Halbach arrays as a function of displacement from the mid-plane and at a relative velocity of 45 m/sec.

In addition to generating the accelerating force on the projectile, the pulsed Halbach arrays exert a strong centering force on the fins, providing contact-less guidance of the projectile as it moves through the launcher. FIG. 13 is a plot of this force, as a function of lateral displacement of a fin from a plane midway between the two facing pulsed Halbach arrays. That is, FIG. 13 shows the calculated centering force exerted on each fin by the pulsed Halbach arrays as a function of displacement from the mid-plane and at a relative velocity of 45 m/sec.

Figure 14:
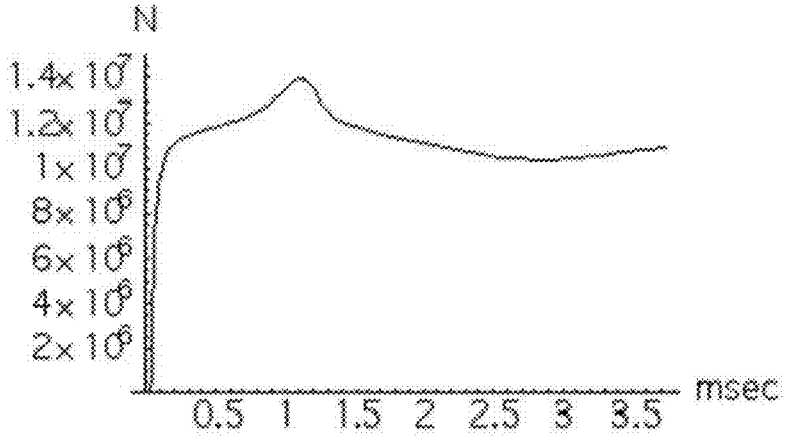
FIG. 14 is a plot of acceleration force exerted on the projectile during its transit down the launcher tube

As the entrained projectile moves down the launcher it experiences an acceleration force, which has been calculated by the TRAV code. FIG. 14 shows a plot of this force as a function of time during the transit of the projectile down the launcher tube.

For this example case the projectile velocity achieved at the end of the launcher is 5050.0 meters/second, corresponding to a kinetic energy at launch of 128.0 Megajoules.

Figure 15:
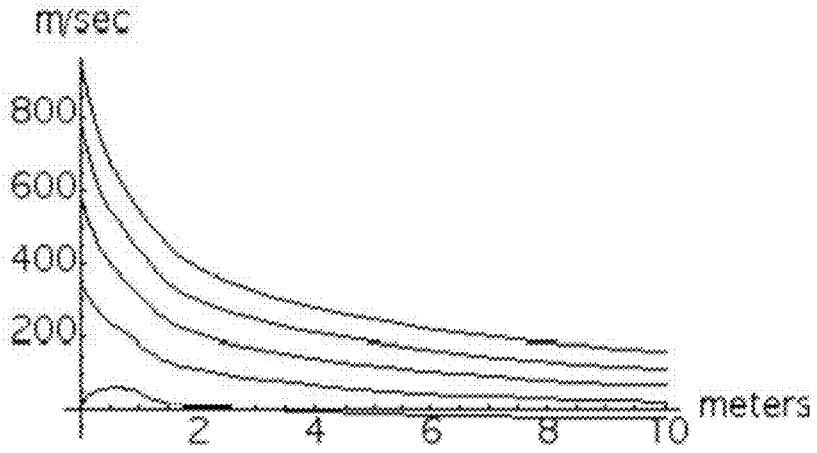
FIG. 15 is plots of local relative velocity between the projectile and the accelerating wave for five equi-spaced positions along the projectile, as a function of position of the end of the projectile.

To show entrainment, the code calculated the relative velocity of 5 equally spaced positions along the projectile as it transits the launcher tube. FIG. 15 shows plots of these five values of relative velocity as a function of distance down the tube. As can be seen from the plots, the relative velocities smoothly converge to small values as the projectile is accelerated, showing entrainment and stable acceleration. The plots show that initially, only a portion of the projectile has a relative velocity that is less than the relative velocity for maximum acceleration. It is this portion that results in initial entrainment of the projectile. Again, FIG. 15 shows plots of local relative velocity between the projectile and the accelerating wave for five equi-spaced positions along the projectile, as a function of position of the end of the projectile.

Figure 16:
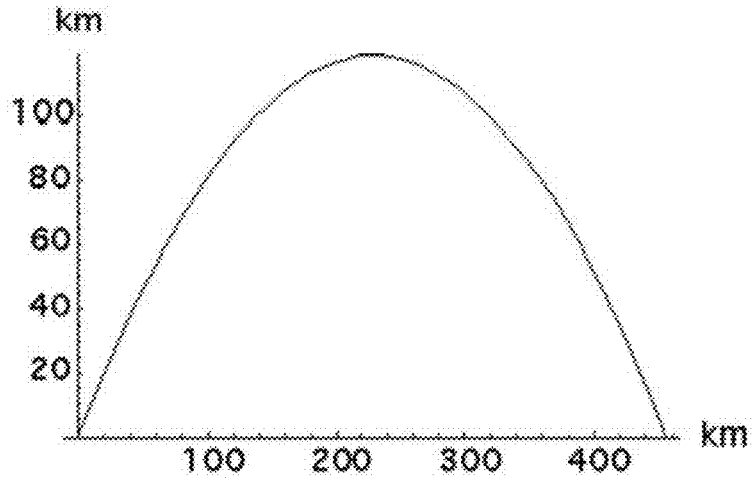
FIG. 16 is a plot of trajectory of five-finned projectile of example case

To obtain a rough idea of the maxim urn range of the accelerated projectile, the trajectory code TRAJ was used, inserting the calculated launch velocity and weight and frontal area parameters of the projectile, and assuming a drag coefficient of 0.3. FIG. 16 is a calculated trajectory for the projectile. The calculated maximum range is 455 kilometers, and the kinetic energy at impact is calculated to be 4.4 Megajoules. (Aerodynamic drag accounts for the much lower kinetic energy at impact relative to that at launch.) The plot of FIG. 16 is the trajectory of five-finned projectile of example case To summarize the results achieved by the INTOR approach, using condenser-discharge circuits to produce the traveling wave it has been shown in an example case that it should be possible to accelerate projectiles to velocities in excess of 5.0 kilometers/second by this technique.

Figure 17:
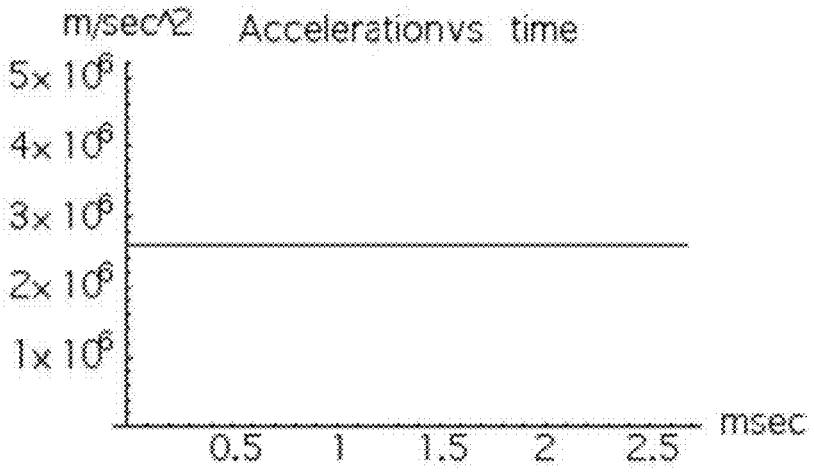
FIG. 17 is a plot of projectile acceleration vs time during the launching process

By satisfying the demanding requirements of high-current output by inverter-based techniques, the velocities achievable through the INTOR approach will be even higher than those achieved by the condenser-discharge technique. When the acceleration code was configured to correspond to this case (i.e., one in which the entire projectile is subjected to the same accelerating wave velocity, so that the finite length of the projectile is not an issue, for the same projectile as the one used in the previous case, even higher projectile velocities are predicted by the TRAV code for the same level of currents in the pulsed Halbach arrays as those associated with the condenser-discharge mode of operation. The following plots illustrate these results. The first plot, FIG. 17, shows the accelerating force as a function of distance down the launcher. Not only is it higher than that achieved in the previous case, but it is constant in value, reflecting the fact of the constancy of phase velocity over the length of the projectile when inverter drive is employed.

Figure 18:
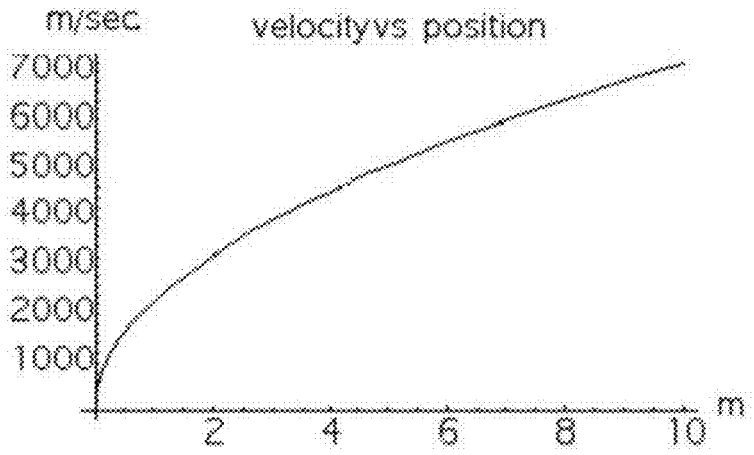
FIG. 18 is a plot of projectile velocity vs position in the launcher

The next plot, FIG. 18, also illustrative of the constancy of the acceleration in this mode of operation, shows the projectile velocity as a function of position down the 10-meter long launcher. For this case the initial velocity of the projectile was 250 meters/sec. and the final velocity was 7.2 km/sec.

Figure 19:
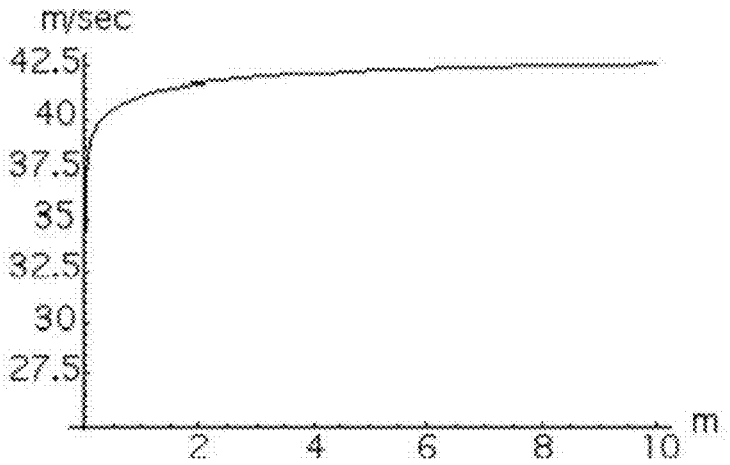
FIG. 19 is a plot of relative velocity between entrained projectile and traveling wave as a function of position in the launcher. Mass of projectile=10 kg.

For this case the relative velocity ("slip") between the traveling wave and the projectile was approximately constant and just below the relative velocity for maximum acceleration, representing stable entrainment and acceleration of the projectile. FIG. 19 is a plot of the relative velocity as a function of the position of the projectile in the launcher. Here, the mass of projectile was 10 kg.

Figure 20:
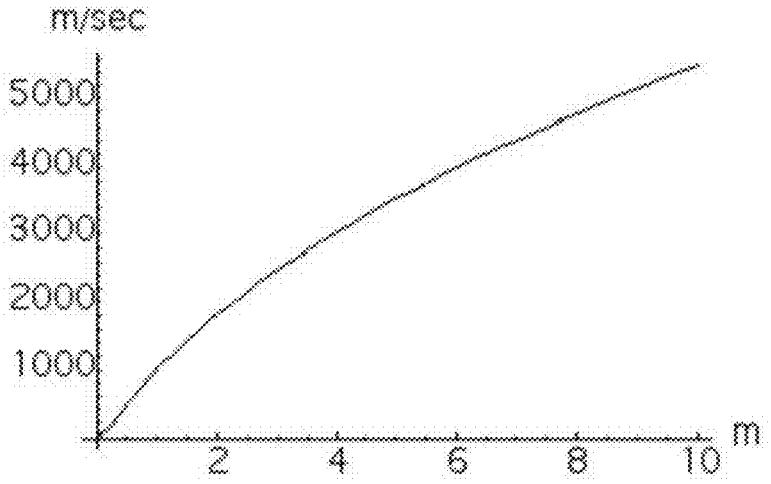
FIG. 20 is a plot of relative velocity between projectile and traveling wave as a function of position in the launcher with loss of entrainment. Mass of projectile=11 kg.

To illustrate what happens when the accelerating force is too weak to stably entrain the projectile, the TRAV code was run with all the parameters but where the mass of the projectile has the same values. When the mass was increased from 10 kg to 11 kg, entrainment was lost, and the velocity only increased to 1.7 km/sec. The loss of entrainment is clearly seen in FIG. 20, which plots the relative velocity between the projectile and the wave as the projectile moves down the launcher.

The examples given here are illustrative of the performance of a linear induction-type accelerator based on the use of pulsed Halbach arrays. In addition to achieving higher launch velocities, the INTOR approach does not involve the contact-related and launcher wear problems of the rail gun, as well as being potentially of much higher efficiency in terms of the fraction of the input electrical energy transferred to the projectile. Certainly it is worthy of further investigation, both theoretical and experimental.

The FLUXOR launcher takes advantage of a phenomenon that is well known in the field of the physics of high-temperature plasmas. That is, the trapping of magnetic flux in a medium having a high electrical conductivity. Thus if one immerses a material with high electrical conductivity in a strong magnetic field for a long enough time for the field to permeate the conductor, and then turns off the field or quickly removes the conductor from the field, the magnetic flux remains "frozen" within the conductor and persists inside and outside of it for a time of order the "skin-depth" time. The duration of this time is a function of the conductivity and of the size of the conductor, and can be many milliseconds for good conductors, such as aluminum, with thicknesses of order of centimeters. During this time eddy currents within the conductor that are automatically set up by its removal from the initial magnetic field, and that draw their energy from the trapped magnetic field in the conductor, will persist for many milliseconds, along with the magnetic field external to the conductor that is associated with those currents. This external magnetic field can then interact with external currents to produce Lorentz forces on the conductor, for example to accelerate a projectile down a launcher. Provided the acceleration time is less than the skin-depth time, the conductor/projectile can be both accelerated and guided through the launcher by these Lorentz forces. As will be shown, this condition i.e., acceleration times short compared to skin-depth times, are well satisfied for projectiles of the dimensions being considered in this study.

A useful estimate of the skin-depth times in this conductors can be obtained from a simple derivation. Consider the time for the decay of azimuthally directed currents flowing in a conducting cylinder. This situation is equivalent to the decay of current in a one-turn solenoidal coil, for which the electrical parameters, namely inductance and resistance, can be estimated from simple considerations. (See Appendix A for details.)

The expression derived for the time constant is given by Equation 16.

$$\tau = \left[\frac{\mu_0}{\rho}\right]\left[\frac{a^2 t}{2a+i}\right] \text{ seconds} \tag{16}$$

Here $\mu_0=4\pi\times10^{-7}$ henrys/meter, and the resistivity, $\rho$, is equal to $2.5\times10^{-8}$ ohm-meters (aluminum). The inner radius of the cylinder is a (m), and t (m) is its thickness. Inserting, for example, a=0.1 m. and t=0.02 meters into Equation 16, one finds $\tau$=45 milliseconds. This decay time is thus much longer than the characteristic acceleration times of the launcher, validating the assumption that was made in analyzing the FLUXOR approach, i.e., that the conductivity-trapped field will remain nearly constant throughout the launching process.

The FLUXOR approach can also be employed with a finned projectile such as was shown in FIGS. 6A and 6B. In this case the relative flux decay time is that for a slab-like geometry. An approximate figure for the flux decay time for this geometry can be obtained from the conventional definition of the skin depth for a conductor in terms of the frequency of an incident wave and the resistivity of the conductor. As shown in Appendix A, defining the characteristic decay time in terms of the reciprocal of the frequency (i.e., the period) of the wave, the expression for the decay time, $\tau$, is given by equation 17.

$$\tau(\text{slab}) = \left[\frac{\pi\mu_0}{\rho}\right]t^2 \text{ seconds} \tag{17}$$

Inserting the values for the resistivity (aluminum) and taking the slab thickness t=20 mm., the flux-decay time is found to be 63 milliseconds, an order of magnitude longer than the acceleration times.

Exemplary steps involved in employing the FLUXOR approach to accelerate a projectile can be divided into four separate operations: These are the following:

1. Loading the projectile into the coil system prior to flux trapping;

2. Energizing the magnet coils that induce the trapped flux for a sufficient time to allow the field to "soak" into the projectile (typically of order 100 milliseconds);

3. Rapidly pulsing down the inducing field (and/or separating the projectile from the magnet roils by moving either one axially); and 4. Exposing the projectile to azimuthally directed currents flowing in a sequence of pulsed launching/centering coils so as to accelerate the projectile down the launcher while at the same time providing contact-less guidance.

Figure 21:
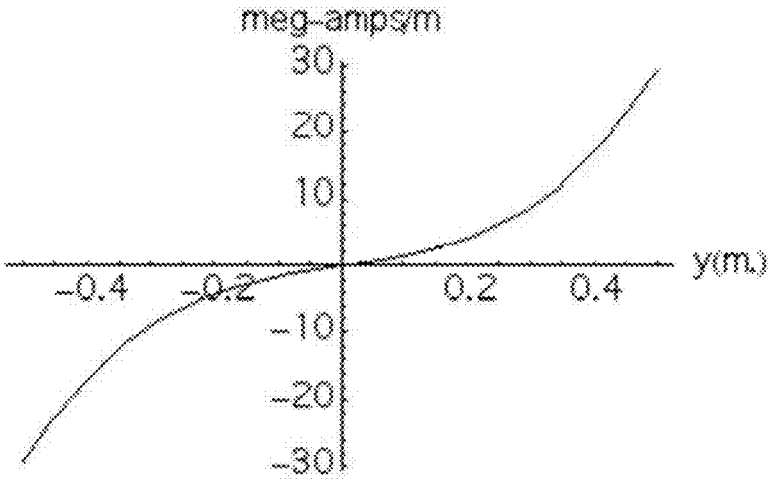
FIG. 21 is a profile of current density in exciter coils to produce a uniform transverse magnetic field in the region between the coils.

The requirements for executing step No. 2 in the list above would be about the same whether the conductor in the projectile boundary was in the form of a cylinder or was of the multi-finned form as used in the INTOR approach. The issue here is how to generate a strong transverse magnetic field in the projectile conductor. For the case of a cylindrical conductor, the requirement is to generate a strong radially directed field throughout the length of the cylinder. A way to accomplish this is to use pulsed cylindrical "exciter" coils closely adjacent to both the outer and the inner surface of the projectile conductor. If the current density in both these coils increases in strength axially in both directions from the middle of the projectile conductor, reversing direction below the midpoint, this will create the desired radially directed magnetic field within the conductor. FIG. 21 shows the profile of the current density (amperes per meter) in exciter coils to produce a uniform transverse magnetic field in the region between the coils.

Figure 22:
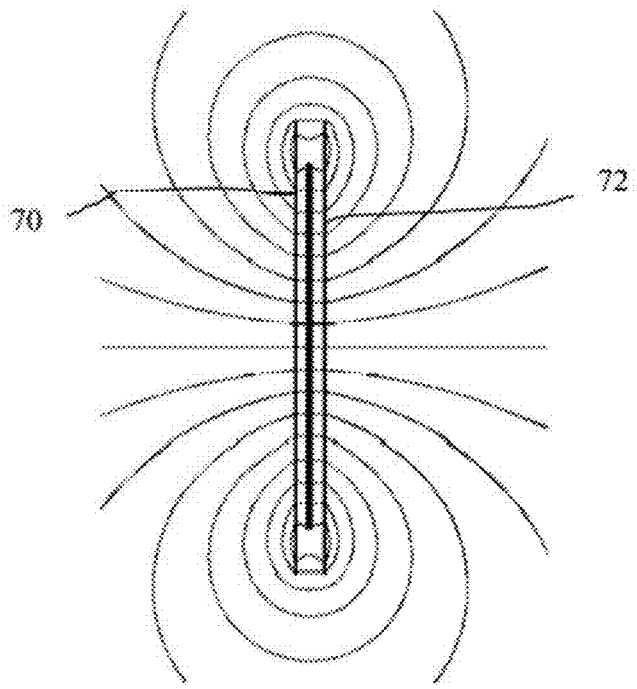
FIG. 22 is a configuration of field lines between two "exciter" coils (outer two dense vertical lines) produced by current distribution shown in FIG. 21.

A computer program, TFLUX, was written to calculate the magnetic field configuration employed in the FLUXOR approach. (See Appendix E for a description of this program). FIG. 22 shows the calculated configuration of the field lines between the exciter coils 70 and 72 (shown as the outer two dense vertical lines in the plot). The exciter coils could either be viewed as a cross-section of one side of two concentric cylindrical coils (the two vertical dense lines) enclosing a cylindrical flux-trapping conductor (the thick vertical line between them) or as the side view of two planar exciter coils with a conducting fin between them. That is, FIG. 22 shows the configuration of field lines between two "exciter" coils (outer two dense vertical lines) produced by current distribution shown in FIG. 21. The location of the flux-trapping conductor, with a length of 0.8 meters, is shown by the heavy vertical line between the exciter coils.

Figure 23:
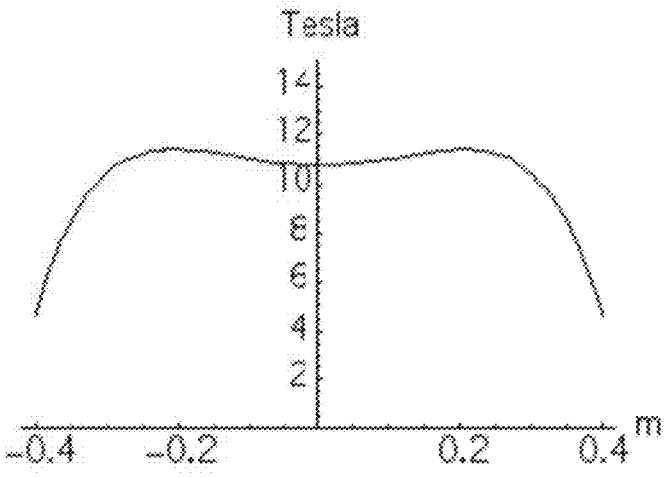
FIG. 23 is a calculated axial variation of transverse magnetic field of FIG. 22, as produced by axial variation of current density in the exciter coils as shown in FIG. 21.

FIG. 23 shows the calculated axial variation of the strength of the magnetic field between the exciter coils. As can be seen from the FIGS. 22 and 23, along most of the length of the conductor the applied field is directed transversely and is nearly constant in magnitude over the length of the flux-trapping conductor. Step 2 requires that the exciter field be maintained for a "soaking-in" time of the conductor, typically of the order of 100 milliseconds. Again, FIG. 23 shows the calculated axial variation of the transverse magnetic field of FIG. 22, as produced by axial variation of current density in the exciter coils as shown in FIG. 21.

Given the profile of the conductivity-trapped magnetic field as shown in FIG. 23 it is now possible to determine the critical parameters associated with Step No. 4 of the launching sequence, i.e., accelerating and launching the projectile by the Lorentz forces associated with pulsed currents in the accelerator coils located along the length of the launcher. To determine the order of magnitude of the currents required in these coils, the computer code TFLUX was used to calculate these forces for a case where the currents flow azimuthally in a multi-turned coil the inner diameter of which is only slightly larger than the projectile (in this case in the form of a thick-walled cylinder). In the example case the current in the conductor is 100,000 amperes and the number of turns per meter is 50. The conducting cylinder (projectile) is made of aluminum, has a length of 0.5 meters, an outer radius of 0.075 meters, a wall thickness of 0.0175 meters and a mass of 15.7 kilograms. From Equation 16, the estimated flux decay time in the cylinder is 21.9 ms. For this example case, the calculated transit time in the launcher is 4.1 ms and the final velocity is 5.4 km/sec., starting from an initial velocity of 0.25 km/sec.

While useful to establish the current and time parameters for this approach, the use of a single coil to accelerate the projectile is not practical. For example, the inductance of such a solenoid would be high, causing difficulties with the pulsed circuitry. Second, the "back emf" voltages generated in the coil by the motion of the flux-trapping projectile through it would be prohibitively high. A practical approach is to divide the launcher into "cells" that consist of conductor arrays of a type to be described. These cells can be excited by pulse circuits employing capacitors and solid-state or spark-gap-type switches.

An analysis has been made of the number and type of such circuits that would be required to achieve the velocities predicted in the single-coil example given above. Each such circuit would consist of a condenser bank discharging into a conductor configuration that would provide the azimuthal current needed to drive the flux-trapping conductor while at the same time it minimizes the "stray" inductance of the circuit. The computer code LCDIS (See Appendix F for a description) was written to perform an analysis of the coupled electrical and electromechanical differential equations describing the forces produced by an condenser bank producing a pulsed current input into these "driver" circuits, taking into account the presence of "back emf" induced in these circuits by the motion of the projectile past them for a cell 0.1 meter in length.

Figure 24:
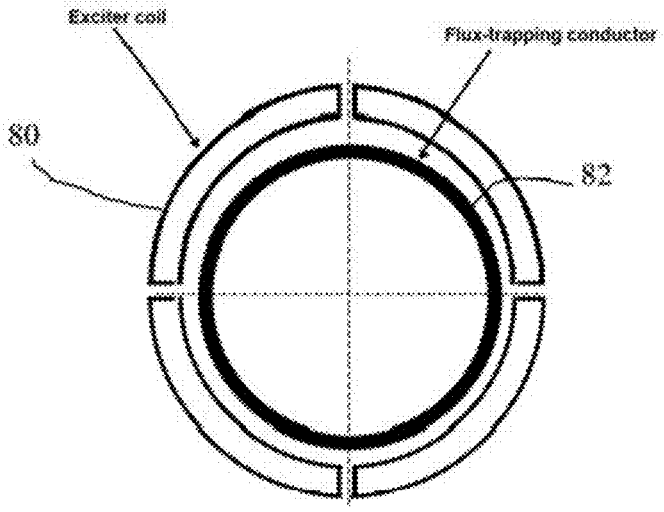
FIG. 24 is a schematic drawing of "exciter" coils of a accelerator cell

The level of energy gain, averaging about 2.5 megajoules per cell length, suggests that it could be advantageous to use more than one, say three or four, pulse discharge circuits per cell length. FIG. 24 is a schematic drawing of "exciter" coils 80 around a flux-trapping conductor 82 of an accelerator cell. The conductor arrays for these circuits can then be in the form of rectangular coils bent to conform to the curvature of the projectile conductor in the manner shown in FIG. 24. Each such circuit would then be driven by a condenser bank storing approximately 1.0 megajoules of electrical energy.

Figure 25:
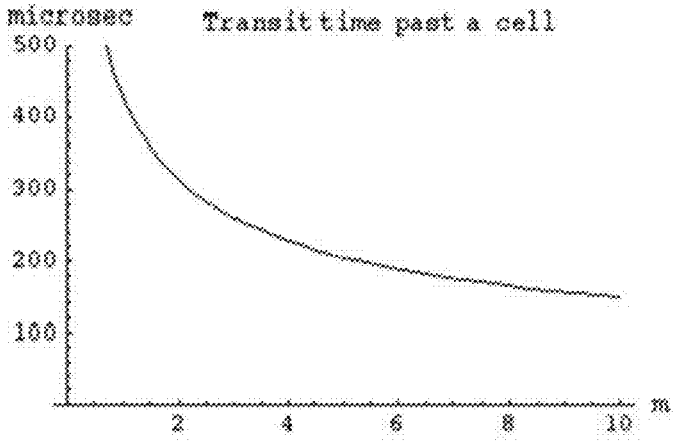
FIG. 25 is an approximate transit time across cells at the launcher location shown, evaluated for a flux-trapping conductor with a length of 0.8 meter accelerated to a final velocity of 5.0 km/sec.

Continuing the discussion of the multi-celled approach to the FLUXOR drive circuitry, the LCDIS code was used to calculate the approximate transit times past each of the cells as a function of position down the launcher. For the calculations to follow, the length of the flux trapping conductor was taken to be 0.8 meters, as shown in FIG. 22. The result is shown plotted in FIG. 25, which shows the approximate transit time across cells at the launcher location shown, evaluated for a flux-trapping conductor with a length of 0.8 meter accelerated to a final velocity of 5.0 km sec.

As can be seen from the plot, except near the breech end of the launcher, the transit times per cell are substantially less than 500 microseconds. The implication of this fact is that by recharging the cell-circuit condensers in a period of order 500 microseconds after their discharge, each such circuit could be employed several times during the acceleration of the projectile. In the example given earlier, where the transit time was of order 4.0 milliseconds, this means that each cell circuit can be charged and discharged (from a "master energy storage hank") approximately 10 times. In other words each cell-circuit group can be counted on to energize 1.0 meter of the launcher. Thus the entire launcher can be powered by it) cell-circuit groups. If there are then three azimuthally distributed cell-circuits per cell length, there will then be a total of 30 small sub-banks needed to power the launcher.

Figure 26:
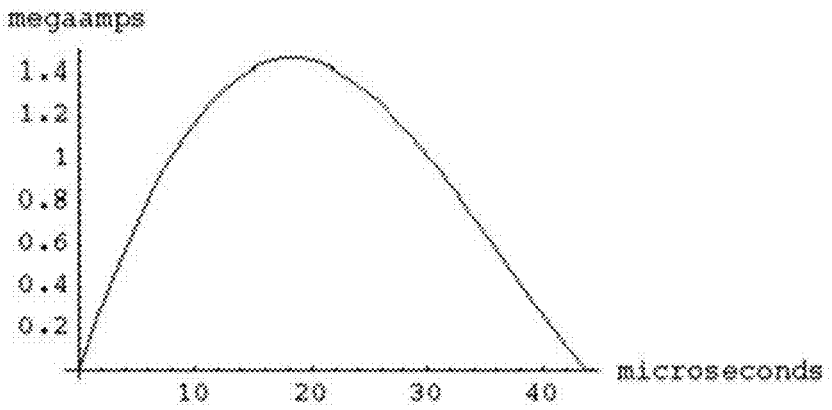
FIG. 26 is a plot of current vs time in the conductors of a driver circuit located half-way down the launcher

Finally, if there are 100 cells (launcher length divided by cell length), and the final velocity is 5000 meters per second, then on average each cell must contribute a velocity increment of approximately 50 meters per second. With three circuits distributed azimuthally per cell this means that each sub-bank needs to contribute a velocity increment of approximately 16 meters per second. The code LCDIS can now be used to estimate the size of condenser and the charging voltage needed to satisfy this requirement. An example case was run in which the capacity of each sub-bank was 1200 microfarads and the bank was charged to 40,000 volts, giving a stored energy of 0.96 megajoules. This sub-bank was discharged into a circuit made of a stack of 4 "coils" in the shape of narrow rectangles bent to fit around the circumference of the flux-trapping conductor of the projectile, as illustrated in FIG. 24 for the case of four circuits per cell. In the calculated example, each coil covered one-third of the circumference so that each cell had four powered conductors to generate the axially directed Lorentz force acting on the flux-trapping conductor. FIG. 26 is a plot of the current vs time in one of the driver circuits located half-way down the launcher.

Figure 27:
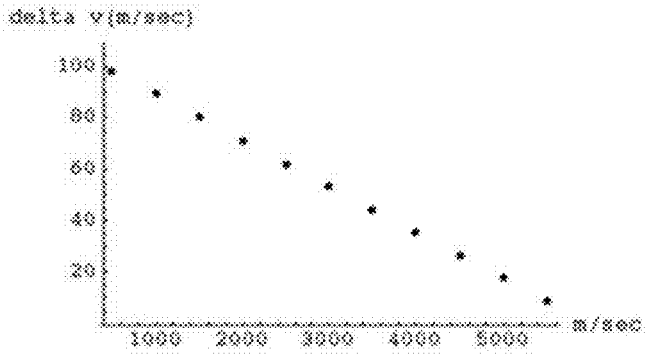
FIG. 27 is a plot of velocity increment per cell as a function of projectile velocity during acceleration.

To obtain the increment in velocity derived from the current pulse in a cell, the LCDIS code integrates the current profile of FIG. 26 over time, and multiplies it by the strength of the trapped-flux field and by the total azimuthal length of driver circuit conductor that is exposed to that field. FIG. 27 is a plot of points showing the calculated velocity increments for the above case, as evaluated at various positions down the launcher.

Figure 28:
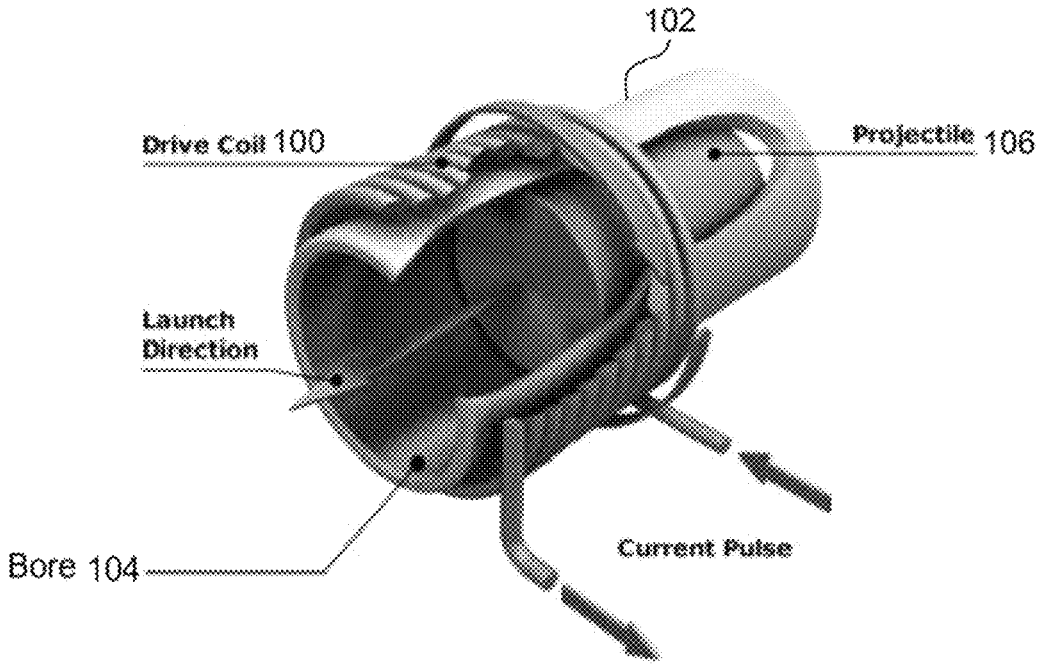
FIG. 28 (Prior Art)
FIG. 28 shows a prior art coil gun configuration.
Figure 29:
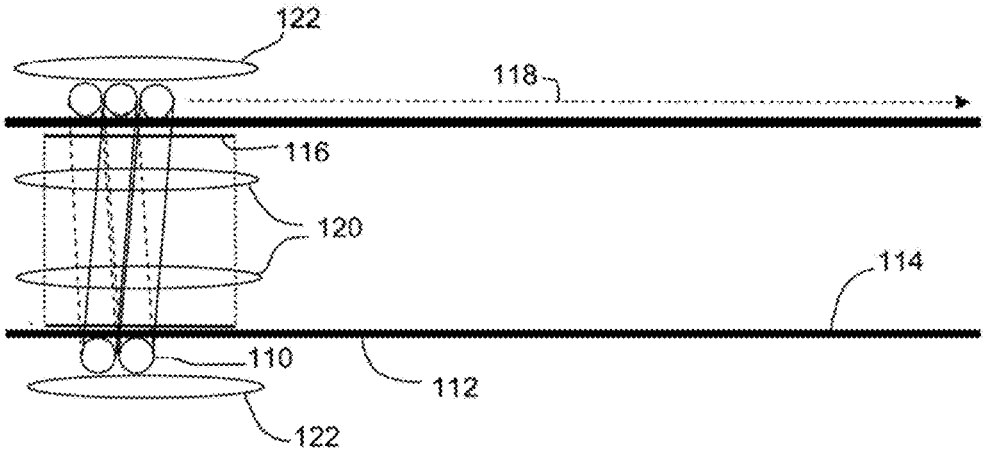
FIG. 29 is a side sectional view of an embodiment of the present invention.

FIG. 28 shows a prior art coil gun configuration. A multi-turn coil 100 is wrapped around a launcher 102 which includes a bore 104. A projectile 106 is loaded into the launcher. FIG. 29 is a side sectional view of an embodiment of the present invention. The figure shows a multi-turn coil 110 is wrapped around a launcher 112 which includes a bore 114. A projectile 116 is loaded into the launcher. Although only a couple of turns of the multi-turn coil is shown, the coil extends down the launcher, as indicated by arrow 118. The projectile 116 is an open cylinder, which allows this embodiment to include an inner set of exciter coils 120. The system also includes an outer set of exciter coils 122.

The final velocity may be determined by calculating the average velocity gain per cell, as averaged over the projectile velocity down the launcher, and then multiplying this figure by the number of cells (100 in the example case). Using the code LCDIS with an initial velocity of 500 m/sec., the calculated final velocity predicted by the code for a projectile with a mass of 15.0 kilograms and a length of 0.8 m. is 5.8 km/sec.

While the calculations given above are for the case of a cylindrical flux-trapping conductor, the same computer codes that were developed to analyze the FLEXOR approach can be used to calculate the performance of a finned projectile. Such a projectile would have the advantage that the driver circuits could be designed to develop propulsion forces on both surfaces of each fin, whereas in the case of a cylindrical flux-trapping conductor only the outer surface can be so employed. In this case it should be possible to achieve higher velocities with similar drive circuits than the velocities achievable with circular flux-trapping conductors.

In summary of this description of the FLUXOR approach to launching, computer codes that can be used to estimate the performance of such a launcher have been written and example cases have been presented that show the capability to achieve projectile velocities of order 5 km/second.

APPENDIX A

Approximate Formulae for Decay Times of Flux-Trapping Conductors

A.1: Thick-Walled Conducting Cylinder

Consider first the case of a thick-walled cylindrical conductor. The analysis consists of evaluating the inductance and the resistance of such a cylinder, considered as a one-turn coil, and then calculating the characteristic decay time, $\tau$, of such an inductor from the relationship $\tau=(L/R)$ seconds.

The magnetic field within the solenoid is given in terms of the linear current density, j (amperes per meter), by Equation 16.

$$B=\mu_0 j \text{ (Tesla)} \tag{16}$$

The inductance of the solenoid can be estimated using the relationship between the stored magnetic energy and the total current in an inductor, given by Equation 17.

$$\frac{1}{2}LI^2 = \int \frac{B^2}{2\mu_0} dV \text{ (Joules)} \tag{17}$$

Taking the length of the solenoid as s(m), its inner radius as a(m), and its wall thickness as t(m), Equations 16 and 17 can be used to define an equation for the inductance of our one-turn solenoid and its electrical resistance as:

$$L = \pi\mu_0\left[\frac{a^2}{s}\right] \text{ Henrys} \tag{18}$$

$$R = \frac{\pi(a+t)}{st}\rho \text{ Ohms} \tag{19}$$

Here $\mu_0 4\pi\times10^{-7}$ (henrys-meter) and $\rho$ (ohm-meters) is the resistivity Of the conductor ($2.5\times10^{-8}$ ohm-m for aluminum).

The time constant, $\tau$ (sec), for the decay of current in an L-R circuit is L/R seconds. Dividing Equation 18 by Equation 19 leads to a field decay time for a cylindrical conductor as given by Equation 20:

$$\tau = \left[\frac{\mu_0}{\rho}\right]\left[\frac{a^2 t}{2a+t}\right] \text{ seconds} \tag{20}$$

Inserting, for example, a=0.1 meters, s=0.02 meters, and the conductivity of aluminum one finds $\tau$=46 milliseconds.

A.2: Flux-Trapping Conductor in the Form of a Flat Slab

Consider next an approximate formula for the decay time of trapped flux in a conducting slab. This formula can be obtained from the equation for the skin-depth of a conducting surface by interpreting the decay time as the reciprocal of the frequency in that formula. The equation for the skin-depth, $\delta$, is the following:

$$\delta = \left[\frac{2\rho}{\omega\mu_0}\right]^{1/2} \text{ meters} \quad (A1)$$

Setting $\delta$=t (meters), the slab thickness, $\omega$(radians/second) is the angular frequency $\rho$(ohm-meters) is the resistivity, and $\mu_0 4\pi\times10^{-7}$ (henrys/meter). Replacing the frequency, f (Hz), in the relationship $\omega=2\pi f$ by $(1/\tau)$, one obtains an approximate formula for the flux decay time as $$\tau = \left[\frac{\pi\mu_0}{\rho}\right]t^2 \text{ seconds} \quad (A2)$$

For aluminum ($\rho=2.5\times10^{-8}$ ohm-meter) and t=20 mm., $\tau$=63 milliseconds.

APPENDIX B

Description of Computer Program TRAJ

The program TRAJ was written to perform calculations, subject to certain approximations, of the trajectory of a projectile launched in the earth's atmosphere at an initial velocity (m/sec) and at a given angle with respect to horizontal. In the calculations the aerodynamic drag coefficient is assumed to be a constant and the earth's curvature is neglected. The atmospheric density is modeled by the "Standard Atmosphere" obtained from engineering tables. The code was benchmarked against known naval artillery data with reasonable agreement. The program, and all of those described in the Appendices to follow were written using the Mathematica® platform.

APPENDIX C

Description of Computer Program HARRY

This program calculates the 2-D magnetic field and the equivalent remanent field of a pulsed Halbach array made up of dipole current elements in the form of rectangular coils the length of which is much larger than the spacing between the wires. The inputs include the current in the coils, the spacing between the wire conductors and the height of the vertically polarized current element above the lower face of the array.

APPENDIX D

Description of Computer Program TRAV

This program uses the 2-D equations of a pulsed Halbach array with an equivalent remanent field (as calculated by the program HARRY) to calculate the centering and accelerating forces exerted on a multi-finned projectile the fins of which comprise a "laminated track." The program can be used to analyze either one of the two types of drive circuitry that can be used to create an accelerating traveling magnetic wave. These types are: (1) acceleration "cells" with a wavelength that increases down the cell, which is then excited by a constant frequency pulse train, or, (2) constant-wavelength cells excited by high-power inverters, with an output frequency that increases with time to create a traveling wave the velocity of which increases with time.

APPENDIX E

Description of Computer Program TFLUX

This program calculates the field-line configuration and field intensity of a pulsed magnetic field used to embed flux in a planar object made of material with a high electrical conductivity. It then uses the calculated field from a pulsed coil surrounding the conductor to calculate the acceleration of the conductor by the Lorentz force from the currents in this coil that are exerted on the fringing trapped magnetic field in the conductor.

APPENDIX F

Description of Computer Program LCDIS

This program also calculates the acceleration of a flux-trapping cylindrical conductor by Lorentz forces. In this program the Lorentz forces are generated by a series of "acceleration cells" made up of azimuthally spaced conductor arrays that are excited by the discharge of small condenser banks. These banks are used repetitively during the acceleration process by recharging them from a "master bank." The program calculates the velocity increment sequentially imparted by the accelerating cells as the velocity increases down the launcher.

The foregoing description of the onion has been presented for purposes of illustration and description and is not intended to be exhaustive or to limit the invention to the precise form disclosed. Many modifications and variations are possible in light of the above teaching. The embodiments disclosed were meant only to explain the principles of the invention and its practical application to thereby enable others skilled in the art to best use the invention in various embodiments and with various modifications suited to the particular use contemplated. The scope of the invention is to be defined by the following claims.

I claim:

1. A apparatus for accelerating a projectile, comprising:

a launcher configured for launching a projectile comprising metallic conductors, wherein said bore comprises a longitudinal axis that is axial with the launch direction of said launcher;

a first set of coils configured for immersing, while said projectile is stationary at a first position within said bore, said metallic conductors in an inducing field of magnetic flux for a first finite period of time, wherein said projectile remains stationary relative to said launcher for the entire duration of said first finite period of time, wherein said inducing field is transverse to said longitudinal axis, wherein flux will be trapped within said metallic conductors for a second finite period of time after said first finite period of time has ended;

means for terminating immersing said metallic conductors in an inducing field of magnetic flux while said projectile is at said first position and is stationary relative to said launcher; and a second set of coils configured for exposing, while said projectile is at said first location and during said second finite period of time, said projectile to operatively directed currents at 90 degrees to said longitudinal axis to accelerate said projectile down said launcher.

2. The apparatus of claim 1, wherein said first set of coils is configured for immersing said metallic conductors in an inducing field for a sufficient time to allow said inducing field to soak into said projectile.

3. The apparatus of claim 1, wherein said operatively directed currents comprise azimuthally directed currents.

4. The apparatus of claim 3, wherein said means for terminating immersing said metallic conductors separates said projectile from said first set of coils by axially moving at least one of said projectile or said first set of coils.

5. The apparatus of claim 4, wherein said second set of coils is configured to be pulsed in a sequence along the longitudinal axis of said launcher to produce said azimuthally directed currents, wherein said projectile will be exposed to said azimuthally directed currents flowing as said second set of coils are sequentially pulsed.

6. The apparatus of claim 5, wherein said second set of coils is configured to provide contact-less guidance along said inner bore.

7. The apparatus of claim 6, further comprising said projectile, wherein said projectile comprises a cylindrical elongated conductor.

8. The apparatus of claim 6, further comprising said projectile, wherein said projectile comprises multiple fins.

9. The apparatus of claim 5, wherein said second set of coils comprises multi-turn conductor coils.

10. The apparatus of claim 5, wherein said cylindrical elongated conductor is hollow.

11. The apparatus of claim 4, wherein said first set of coils comprises a first subset of coils and a second subset of coils, wherein said first subset of coils is configured to provide a first component of said inducing field on the outside of said bore and wherein said second subset of coils is configured to provide as second component of said inducing field along the inner surface of said bore, wherein said first component and said second component combine to produce said transverse field.

12. A method for accelerating a projectile, comprising:

placing a projectile at a first position within a bore of a launcher, wherein said projectile comprises metallic conductors, wherein said bore comprises a longitudinal axis that is axial with the launch direction of said launcher;

while said projectile is at said first position and is stationary relative to said launcher, immersing said metallic conductors in an inducing field of magnetic flux for a first finite period of time, wherein said projectile remains stationary relative to said launcher for the entire duration of said first finite period of time, wherein said inducing field is transverse to said longitudinal axis, wherein flux is trapped within said metallic conductors for a second finite period of time after said first finite period of time has ended;

while said projectile is at said first position and is stationary relative to said launcher, terminating the step of immersing said metallic conductors; and while said projectile is at said first location and during said second finite period of time, exposing said projectile to operatively directed currents at 90 degrees to said longitudinal axis to accelerate said projectile down said launcher.

13. The method of claim 12, wherein the step of immersing said metallic conductors in an inducing field is continued for a sufficient time to allow said inducing field to soak into said projectile.

14. The method of claim 12, wherein said operatively directed currents comprise azimuthally directed currents.

15. The method of claim 14, wherein said launcher comprises a first set of coils for providing said inducing field, wherein the step of terminating the step of immersing said metallic conductors comprises separating said projectile from said first set of coils by axially moving at least one of said projectile or said first set of coils.

16. The method of claim 15, wherein said launcher comprises a second set of coils configured to be pulsed in a sequence along the longitudinal axis of said launcher to produce said azimuthally directed currents, wherein said projectile is exposed to said azimuthally directed currents flowing as said second set of coils are sequentially pulsed.

17. The method of claim 16, wherein said second set of coils is configured to provide contact-less guidance along said inner bore.

18. The method of claim 17, wherein said projectile comprises a cylindrical elongated conductor.

19. The method of claim 17, wherein said projectile comprises multiple fins.

20. The method of claim 16, wherein said second set of coils comprises multi-turn conductor coils.

21. The method of claim 16, wherein said cylindrical elongated conductor is hollow.

22. The method of claim 15, wherein said first set of coils comprises a first subset of coils and a second subset of coils, wherein said first subset of coils is configured to provide a first component of said inducing field on the outside of said bore and wherein said second subset of coils is configured to provide as second component of said inducing field along the inner surface of said bore, wherein said first component and said second component combine to produce said transverse field.

* * * * *